US012722038B2

(12) United States Patent
Parvarandeh et al.

(10) Patent No.: US 12,722,038 B2
(45) Date of Patent: Sep. 1, 2026

(54) EXERCISE EQUIPMENT

(71) Applicant: i.Clarity Innovations LLC, Los Altos, CA (US)

(72) Inventors: Pirooz Parvarandeh, Los Altos, CA (US); Violet Parvarandeh, Los Altos, CA (US); Bobak Parvarandeh, Los Altos, CA (US)

(73) Assignee: i. Clarity Innovations LLC, Los Altos, CA (US)

( * ) Notice: Subject to any disclaimer, the term of this patent is extended or adjusted under 35 U.S.C. 154(b) by 305 days.

(21) Appl. No.: 18/407,237

(22) Filed: Jan. 8, 2024

(65) Prior Publication Data

US 2024/0139578 A1 May 2, 2024

Related U.S. Application Data

(63) Continuation-in-part of application No. 17/443,758, filed on Jul. 27, 2021, now Pat. No. 11,865,398.

(60) Provisional application No. 63/059,759, filed on Jul. 31, 2020.

(51) Int. Cl.
*A63B 21/00* (2006.01)
*A63B 23/035* (2006.01)

(52) U.S. Cl.
CPC .... *A63B 21/4033* (2015.10); *A63B 23/03558* (2013.01); *A63B 2210/50* (2013.01)

(58) Field of Classification Search
CPC ..... A63B 21/4033; A63B 23/03558; A63B 2210/50; A63B 21/4029; A63B 71/0036; A63B 22/0605
See application file for complete search history.

(56) References Cited

U.S. PATENT DOCUMENTS

| | | | | |
|---|---|---|---|---|
| 5,662,556 | A * | 9/1997 | Gangloff | A63B 1/005 482/17 |
| 7,364,530 | B2 | 4/2008 | Lopez | |
| 7,410,450 | B1 | 8/2008 | Paulding | |
| 7,591,763 | B1 | 9/2009 | Fucci | |
| 8,715,144 | B1 | 5/2014 | Freiss | |
| 9,272,176 | B1 * | 3/2016 | Bendror | A63B 23/1209 |
| 10,293,206 | B2 * | 5/2019 | Kamins | A63B 21/156 |
| 11,865,398 | B1 | 1/2024 | Parvarandeh et al. | |
| 2004/0067828 | A1 | 4/2004 | Croft | |
| 2004/0176227 | A1 | 9/2004 | Endelman | |

(Continued)

FOREIGN PATENT DOCUMENTS

WO 2008010797 A1 1/2008

*Primary Examiner* — Andrew S Lo
(74) *Attorney, Agent, or Firm* — Haverstock & Owens, A Law Corporation

(57) ABSTRACT

An exercise equipment has a structure that can be easily collapsed for storage, and that provides improved utility due to its multiple functional capabilities and configurations thereby enabling a comprehensive set of strength exercises. The exercise equipment includes a rigid base structure that can be folded into compact form when not in use and can be configured for accessories that attach to the base structure. The exercise equipment with attached accessories combines heretofore separate pieces of equipment into one that covers a fraction of the floor space of all such separate pieces of equipment. This provides exercise equipment that is more flexible, more functional, and has a smaller footprint, all of which can be folded up for compact storage.

21 Claims, 34 Drawing Sheets

(56) References Cited

U.S. PATENT DOCUMENTS

| | | | | |
|---|---|---|---|---|
| 2005/0130814 | A1* | 6/2005 | Nitta | A63B 1/00 482/121 |
| 2008/0171643 | A1* | 7/2008 | Baudhuin | A63B 22/0087 482/148 |
| 2009/0111657 | A1* | 4/2009 | Snow | A63B 21/4013 482/142 |
| 2009/0215594 | A1* | 8/2009 | Panaiotov | A63B 21/16 482/130 |
| 2013/0331232 | A1* | 12/2013 | Kwo | A63B 1/00 482/38 |
| 2014/0087920 | A1* | 3/2014 | Nickel | A63B 3/00 482/41 |
| 2015/0038304 | A1 | 2/2015 | Davenport | |
| 2016/0296785 | A1* | 10/2016 | Kamins | A63B 69/0062 |
| 2016/0354629 | A1 | 12/2016 | Salamon | |
| 2017/0021217 | A1* | 1/2017 | Slayton | A63B 21/4035 |
| 2018/0008857 | A1 | 1/2018 | Barber | |
| 2018/0236289 | A1 | 8/2018 | Allen | |
| 2019/0111302 | A1 | 4/2019 | Ballestero | |
| 2019/0329095 | A1 | 10/2019 | Noren | |
| 2020/0114194 | A1 | 4/2020 | McGhee | |
| 2021/0016130 | A1 | 1/2021 | Cope | |
| 2021/0170218 | A1* | 6/2021 | Lewis-Dove | A63B 17/04 |
| 2021/0346750 | A1 | 11/2021 | Reed, III | |
| 2021/0402248 | A1* | 12/2021 | Clark | A63B 21/0442 |
| 2022/0379165 | A1* | 12/2022 | Alfandre | A63B 21/00047 |
| 2023/0019254 | A1* | 1/2023 | Adams | A63B 23/0464 |

* cited by examiner

EXERCISE EQUIPMENT

RELATED APPLICATIONS

This Patent Application is a continuation-in-part of U.S. patent application Ser. No. 17/443,758, filed Jul. 27, 2021, and titled "Exercise Equipment," which claims priority under 35 U.S.C. 119(e) of the U.S. provisional patent application, Application Ser. No. 63/059,759, filed on Jul. 31, 2020, and titled "Exercise Equipment", both of which are hereby incorporated by reference in their entireties.

FIELD OF THE INVENTION

The present invention is generally directed to exercise equipment. More specifically, the present invention is directed to exercise equipment that is reconfigurable into multiple different positions for enabling a user to perform a variety of different exercises and for storing in a compact size.

BACKGROUND OF THE INVENTION

Exercise equipment provides users with enhanced means for performing physical activities, typically for the purpose of improving the user's physical strength and/or conditioning. Many such exercise equipment provides fixed or adjustable amounts of resistance, such as weight machines, or to otherwise enhance the experience or outcome of an exercise routine, such as stationary bikes or rowing machines. Exercise equipment is often fixed in place and occupies a substantial floor space, and can be limited in the number of exercises that can be performed. An exercise routine comprising a number of different exercises may necessitate the use of multiple different exercise equipment. Although plausible in a gym setting, use of multiple different exercise equipment may not be feasible in a user's home, due at least in part to space and cost constraints.

SUMMARY OF THE INVENTION

Embodiments are directed to exercise equipment having a structure that can be easily collapsed for storage, and that provides improved utility due to its multiple functional capabilities and configurations thereby enabling a comprehensive set of strength exercises. The exercise equipment includes, but is not limited to, a rigid base structure that can be folded into compact form when not in use and can be configured for accessories that attach to the base structure. The exercise equipment can also include electronics that are attached to the accessories, communications means between the electronics and an external electronic device, such as a cell phone, the external electronic device and an app (software application) that runs on the electronic device, and a communications network, such as a cloud-based network. The exercise equipment with attached accessories combines heretofore separate pieces of equipment into one, that covers a fraction of the floor space as all separate pieces of equipment. This provides exercise equipment that is more flexible, more functional, and has a smaller footprint, all of which can be folded up for compact storage.

In an aspect, exercise equipment is disclosed. The exercise equipment comprises a base platform, a plurality of base platform hinge assemblies, and a collapsible frame. The base platform comprises a plurality of base platform fastener sites configured for attaching an exercising accessory to the base platform. The plurality of base platform hinge assemblies are coupled to an end of the base platform. The collapsible frame is coupled to the base platform hinge assemblies, wherein the collapsible frame comprises a plurality of frame fastener sites configured for attaching the exercising accessory to the collapsible frame. The plurality of base platform hinge assemblies are configured to move the collapsible frame and the base platform relative to each other and between a folded configuration for storage of the exercise equipment and an unfolded configuration for performing exercises by a user. In some embodiments, the base platform comprises a planar substrate configured to lie on a flat surface. In some embodiments, the base platform comprises rigid rail structure positioned along a perimeter of the planar substrate. In some embodiments, the rigid rail structure is positioned along three sides of the planar substrate. In other embodiments, the rigid rail structure circumnavigates an entire perimeter of the planar substrate. In some embodiments, the base platform fastener sites are formed in the rigid rail structure. In some embodiments, the collapsible frame comprises a plurality of frame sections interconnected by a plurality of frame hinge assemblies. In some embodiments, the plurality of frame hinge assemblies are configured to move the frame sections relative to each other and between the folded configuration and the unfolded configuration, wherein in the folded configuration the plurality of frame sections are folded upon each other. In some embodiments, the plurality of frame sections comprise a first frame section coupled to the base platform via the plurality of base platform hinge assemblies, a second frame section coupled to the first frame section via a first subset of the plurality of frame hinge assemblies, and a third frame section coupled to the second frame section via a second subset of the plurality of frame hinge assemblies. In some embodiments, in the unfolded configuration the first frame section and the second frame section are perpendicular to the base platform, and the third frame section is one of either perpendicular to the base platform, parallel to the base platform, or angled to the base platform. In some embodiments, the exercise equipment further comprises a support member configured to attach to a fastener site on the third frame section and a fastener site of the second frame section when the third frame section is positioned either perpendicular to the base platform or angled to the base platform. In some embodiments, the exercising accessory is attached to either the base platform via one or more of the plurality of base platform fastener sites, the collapsible frame via one or more of the plurality of frame fastener sites, or both the base platform via one or more of the plurality of base platform fastener sites and the collapsible frame via one or more of the plurality of frame fastener sites. In some embodiments, the exercise equipment further comprises a fastener configured to removably fasten and unfasten at each of the plurality of fastener sites, wherein the fastener includes a first fastener element configured to mate with a complementary fastener element at the fastener site and a second fastener element configured to mate with a complementary fastener element on the exercising accessory. In some embodiments, an attachment position of the exercising accessory on the base platform is adjustable by selectively attaching the fastener to one of the plurality of base platform fastener sites. In some embodiments, an attachment position of the exercising accessory on the collapsible frame is adjustable by selectively attaching the fastener to one of the plurality of frame fastener sites. In some embodiments, the exercise equipment further comprises a fastener configured to removably fasten and unfasten at each of the plurality of fastener sites, wherein the fastener includes a first fastener element configured to mate with a complementary fastener element at the fastener site and a pulley. In some embodiments, the exercise equipment further comprises a plurality of wheels coupled to the base platform, wherein in the unfolded configuration the wheels do not contact the ground, and in the folded configuration the wheels enable the exercise equipment to be moved to a storage location. In some embodiments, the exercise equipment further comprises a crankshaft coupled to the base platform that when positioned in a vertical storage position enables the folded base platform to be lowered to a horizontal position. In some embodiments, the exercising accessory comprises a resistance band. In some embodiments, the exercising accessory comprises a back rest. In some embodiments, the exercising accessory comprises a back rest with arm bars. In some embodiments, the exercising accessory comprises a stationary bike. In some embodiments, the exercise equipment further comprises a plurality of exercising accessories, each one of the plurality of exercising accessories attached to either the base platform via one or more of the plurality of base platform fastener sites, the collapsible frame via one or more of the plurality of frame fastener sites, or both the base platform via one or more of the plurality of base platform fastener sites and the collapsible frame via one or more of the plurality of frame fastener sites. In some embodiments, the plurality of exercising accessories comprise a plurality of resistance bands, further comprising a moveable element coupled to the plurality of resistance bands. In some embodiments, the plurality of resistance bands are attached at different angles to the moveable element to enable multi-directional force vectors applied to the moveable element. In some embodiments, the moveable element comprises a bar or a slidable seat.

In another aspect, an exercise equipment includes a base platform including a plurality of base platform fastener sites configured for attaching an exercising accessory to the base platform; a hinge structure including first and second hinges; and a collapsible frame including first and second frame sections, the first and second frame sections including a plurality of frame fastener sites configured for attaching the exercising accessory to the collapsible frame, wherein the first hinge couples the base platform to the collapsible frame, the second hinge hingedly couples the first frame section to the second frame section, the first hinge configured to rotate the base platform relative to the collapsible frame in a first plane, the second hinge configured to rotate the first frame section relative to the second frame section in a second plane orthogonal to the first plane, such that the first and second frame sections fold upon each other, the rotations to expand and collapse the exercise equipment into folded and unfolded configurations.

In some embodiments, in the unfolded configuration, the frame fastener sites are arranged in parallel columns extending from a proximal end of the first frame section relative to the base platform to a distal end of the second frame section relative to the base platform. In some embodiments, in the unfolded configuration, the frame fastener sites are arranged to secure the exercising accessory at different distances from the base platform. In some embodiments, the base platform includes a planar substrate configured to lie on a flat surface.

In some embodiments, the exercise equipment further includes the exercising accessory coupled to one or more of the fastener sites. In some embodiments, the exercising accessory includes a pull-up bar, a bench attachment, a weight module, a rowing machine assembly, a leg curl assembly, a backrest and horizontal bar assembly, a T-Bar, a bicycle assembly, or a Smith Machine assembly.

In some embodiments, the exercising accessory includes a seat track for slidably coupling a seat and legs coupling the seat track to the base platform fastener sites. In some embodiments, the exercising accessory includes a bicycle assembly with a flywheel coupled to a pedal assembly, the pedal assembly including pedals, wherein a distance of the pedals from the frame, a distance of the pedals from the seat track, or both are adjustable.

In some embodiments, the base platform includes opposing strips coupled by a cross strip forming a perimeter of an enclosure, such that when the exercise equipment is in the folded configuration, the first and second frame sections are at least partially contained within the enclosure.

In some embodiments, the cross bar includes one or more anti-tilt bars, a wheel set, or both.

In another aspect, exercise equipment includes a base platform including opposing first and second strips coupled by a cross strip, the base platform including a plurality of base platform fastener sites configured for attaching an exercising accessory to the base platform; and a collapsible frame including first and second frame sections hingedly coupled together and to the base platform, the multiple frame sections comprising a plurality of frame fastener sites configured for attaching the exercising accessory to the collapsible frame, wherein, the first and second sections are configured to rotate relative to each other in a first plane defined by the first strip, the second strip, and the cross strip, orthogonal to a surface of the base platform, and to rotate relative to the base platform in a second plane orthogonal to the first plane, to move the collapsible frame between folded and unfolded configurations. In some embodiments, the multiple frame sections are directly hingedly coupled to each other.

In some embodiments, the exercise equipment further includes a fastener configured to removably fasten and unfasten at each of the plurality of fastener sites, wherein the fastener includes a first fastener element configured to mate with a complementary fastener element at the fastener site and a second fastener element configured to mate with a complementary fastener element on the exercising accessory.

In another aspect, exercise equipment includes a base platform including a plurality of base platform fastener sites configured for attaching an exercising accessory to the base platform; and a collapsible frame coupled to the base platform, wherein the collapsible frame includes first and second frame sections, the first frame section hingedly coupled to both the second frame section and the base platform, the first frame section having a first face and opposing first side surfaces, the second frame section having a second face and opposing second side surfaces, the first and second faces including a plurality of frame fastener sites configured for attaching the exercising accessory to the collapsible frame, wherein the exercise equipment is configured such that in a folded configuration, corresponding ones of the first and second side surfaces are folded upon each other and the first frame section is folded upon the base platform, and in an unfolded configuration, the first and second faces are aligned, such that the first section supports the second section on the base platform.

In some embodiments, one of the first opposing side surfaces or one of the second opposing side surfaces includes one or more of the multiple frame fastener sites. In some embodiments, the base platform includes a planar substrate configured to lie on a flat surface and a rigid rail structure positioned along a perimeter of the planar substrate. In some embodiments, the base platform fastener sites are formed in the rigid rail structure.

In another aspect, exercise equipment includes a base platform including a plurality of base platform fastener sites configured for attaching an exercising accessory to the base platform; and a collapsible frame including multiple frame sections wherein adjacent ones of the multiple frame sections are directly hingedly coupled to each other, the multiple frame sections including a plurality of frame fastener sites configured for attaching the exercising accessory to the collapsible frame, wherein, for a user on the base platform facing the collapsible frame, the multiple frame sections are configured to rotate relative to each other in a frontal plane and to rotate relative to the base platform in a sagittal plane, to move the collapsible frame between folded and unfolded configurations.

In another aspect, exercise equipment includes a base platform including a plurality of base platform fastener sites configured for attaching an exercising accessory to the base platform; a collapsible frame coupled to the base platform, wherein the collapsible frame includes a first frame section having a first proximal end and a first distal end, the second frame section having a second proximal end and a second distal end, the first distal end hingedly coupled to the base platform, the first and second frame sections each comprising a plurality of frame fastener sites configured for attaching the exercising accessory to the collapsible frame, wherein the first and second frame sections are configured to fold upon each other about a first hinge assembly, and the folded first and second folded sections are configured to fold upon the base platform about a second hinge assembly.

BRIEF DESCRIPTION OF THE DRAWINGS

Several example embodiments are described with reference to the drawings, wherein like components are provided with like reference numerals. The example embodiments are intended to illustrate, but not to limit, the invention. The drawings include the following figures.

DETAILED DESCRIPTION OF THE EMBODIMENTS

Figure 4:
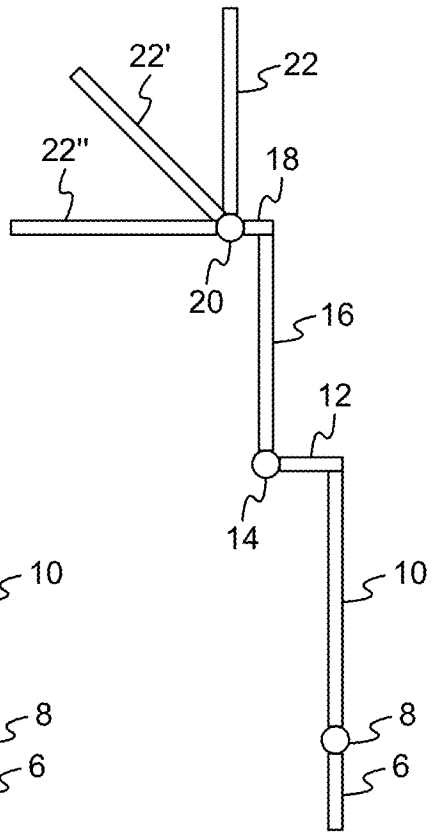
FIG. 4 illustrates a side view of the base structure in an unfolded configuration according to some embodiments.

Embodiments of the present application are directed to exercise equipment. Those of ordinary skill in the art will realize that the following detailed description of exercise equipment is illustrative only and is not intended to be in any way limiting. Other embodiments of exercise equipment will readily suggest themselves to such skilled persons having the benefit of this disclosure.

Reference will now be made in detail to implementations of the exercise equipment as illustrated in the accompanying drawings. The same reference indicators will be used throughout the drawings and the following detailed description to refer to the same or like parts. In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

The base structure of the exercise equipment includes a base platform onto which the user stands, squats, kneels, or otherwise bears their weight. In some embodiments, the base platform comprises a solid planar substrate, such as a rectangular board. The base structure also includes a frame attached at one side of the base platform. The base platform is configured to firmly attach to the frame. In some embodiments, the frame is a scaffolding structure with multiple hinged frame sections. The base structure is enabled for a folded configuration and an unfolded configuration. The frame is configured to be unfolded to lock into a "vertical" structure. The base platform stabilizes the "vertical" structure from toppling over. The base platform is also designed to allow a footprint of the frame to be expanded. The larger the footprint of the base platform, the more stable the overall base structure.

In the folded configuration, the base structure forms a compact volume for convenient storage. In the unfolded configuration, the base structure has a work out area where the user is positioned within a footprint of the base platform. In this manner, when the user is performing an exercise the user's center of mass is vertically aligned over a footprint of the base platform. This provides internal support for the exercise equipment without need of external support means. The weight of the user on the base platform, either directly by standing, squatting, kneeling, or the like on the base platform, or indirectly by the user bearing their weight on a bench, chair, accessory, or the like positioned on the base platform, maintains and stabilizes the exercise equipment in place during performance of an exercise. Dimensions of the base platform, e.g. length and width, are designed according to the composite range of motions of the various exercises to be performed and to ensure that the user's center of mass is maintained within the base platform footprint while performing the exercises. In some embodiments, the solid planar substrate can be slidably removed and replaced with a longer solid planar substrate that increases the length, and therefore the footprint, of the base platform. In other embodiments, the end of the solid planar substrate distal from the frame is configured to enable attachment of an additional solid planar substrate to increase the length of the base platform.

Fastener sites can be located along the base platform and the frame, including any perimeter and cross members. In this manner, connection points (at each fastener site) can be established at most any position on the base structure. Fastener sites are used to connect accessories for performing exercises. Accessories include, but are not limited to, resistance bands, also referred to as tension bands, which can be used to create resistance in a variety of different exercises. The fastener sites are also configured for attachment of other types of accessories, as described below. In some embodiments, such accessories can include additional frame pieces, each with their own one or more fastener sites. Each such frame piece with fastener sites accessory can be mounted to any frame section and/or base platform to provide additional fastener sites. In this manner, frame piece with fastener sites accessories enable a user to manipulate a fastener site(s) in a variety of X, Y (plane of the base platform) and/or X, Z (plane of the frame) locations.

Figure 1:
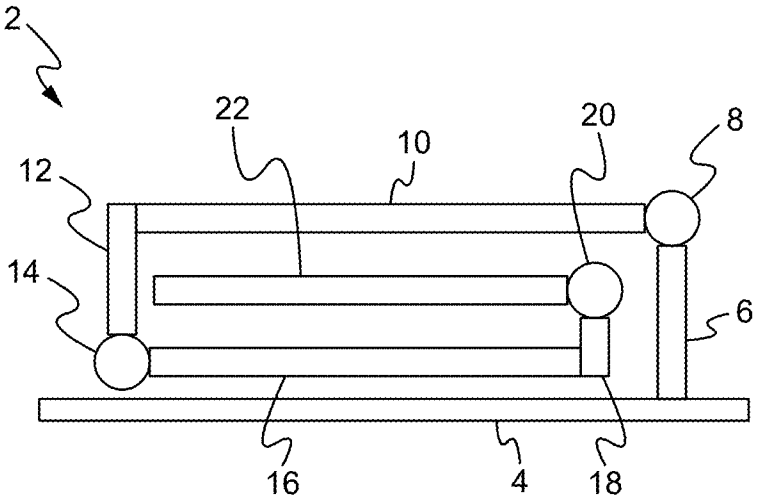
FIG. 1 illustrates a side view of a conceptual block diagram of the base structure in the folded configuration according to some embodiments.

FIG. 1 illustrates a side view of a conceptual block diagram of the base structure in the folded configuration according to some embodiments. The folded base structure can be stored in either a horizontal position, as shown in FIG. 1, or a vertical position (not shown). The folded base structure can include wheels for moving the folded base structure into and out of a storage location. The wheels can be configured with multiple degrees of movement for improved maneuverability when the base structure is folded up. The wheels would not contact the ground in the unfolded configuration, but when folded can be used to move the folded base structure. To unfold the base structure 2 into a usable form, the folded base structure 2 is positioned with the base platform 4 resting on the ground. The frame includes a first frame section 10, a second frame section 16, and a third frame section 22. The first frame section 10 is connected to the base platform 4 via a pair of hinge assemblies 8. The side view shown in FIG. 1 only shows one hinge assembly 8 of the pair of hinge assemblies 8 (see FIG. 5, for example, for both hinge assemblies in the pair). A mounting frame section 6 enables securing of the base platform 4 to the hinge assemblies 8 and can be considered a portion of either the base platform 4 or the hinge assemblies 8 depending on the specific implementation and mounting means. The second frame section 16 is connected to the first frame section 10 via a pair of hinge assemblies 14.

A mounting frame section 12 enables securing of the first frame section 10 to the hinge assembly 14 and can be considered a portion of either the first frame section 10 or the hinge assembly 14 depending on the specific implementation and mounting means. The third frame section 22 is connected to the second frame section 16 via a hinge assembly 20. A mounting frame section 12 enables securing of the first frame section 10 to the hinge assembly 20 and can be considered a portion of either the second frame section 16 or the hinge assembly 20 depending on the specific implementation and mounting means.

Figure 3:
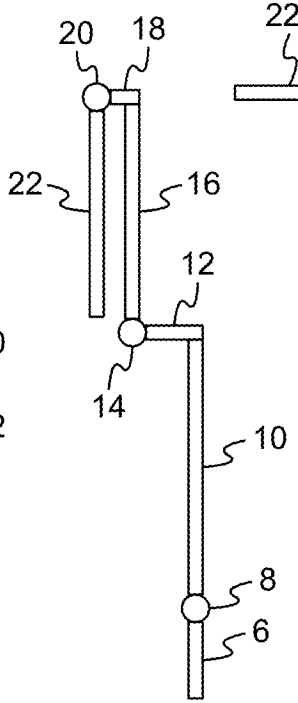
FIG. 3 illustrates a side view of the base structure in a partially unfolded configuration according to some embodiments.
Figure 2:
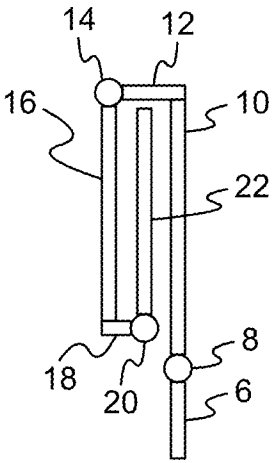
FIG. 2 illustrates a side view of the base structure in a partially unfolded configuration according to some embodiments.

A first pair of latches is unlatched for releasing the folded frame from its locked storage position, thereby enabling a first frame section 10 to be rotated to a first upright position, as shown in FIG. 2, where the first frame section 10 is re-locked into place. The first pair of latches are co-located with the pair of hinge assemblies 8 and are generally shown as element 8. In some embodiments, the first upright position corresponds to the first frame section 10 being perpendicular to the base platform 4. A second pair of latches is unlatched for releasing the second frame section 16, thereby enabling the second frame section 16 to be unlocked from a folded position and rotated from the folded position relative to the first frame section 10. The second frame section 16 is rotated into a second upright position, as shown in FIG. 3, where the second frame section 16 is re-locked into place. The second pair of latches are co-located with the pair of hinge assemblies 14 and are generally shown as element 14. Although FIG. 3 shows the second frame section 16 in a different vertical plane than the first frame section 10 due to the alignment of the mounting frame section 12, it is understood that the mounting frame section 12 can be alternatively configured, such as aligned inline with the first frame section 10 as opposed to the perpendicular alignment shown, such that the second frame section 16 is inline with the first frame section 10. In this case, the second upright position corresponds to both the first and second frame sections being inline with each other and perpendicular to the base platform. A third pair of latches is unlatched for releasing the third frame section 22, thereby enabling the third frame section 22 to be unlocked from the folded position and rotated from the folded position relative to the second frame section 16. The third pair of latches are co-located with the pair of hinge assemblies 20 and are generally shown as element 20. The third frame section 22 is rotated into one or multiple possible positions relative to the second frame section 16, as shown in FIG. 4, where the third frame section 22 is re-locked into place. The range of possible positions of the third frame section ranges from 0-180 degrees relative to the second piece of frame. FIG. 4 shows three different possible locked positions for the third frame section 22. A first position is in the vertical position, shown as third frame section 22, a second position is in a 45 degree angles position, shown as third frame section 22', and a third position is in the horizontal position, shown as third frame section 22". It is understood that the mounting frame section 18 can be alternatively configured, such as aligned inline with the second frame section 16 as opposed to the perpendicular alignment shown, such that the third frame section 22 is inline with the second frame section 10, when the third frame section 22 is in the vertical position. In this case, the vertical position corresponds to both the second and third frame sections being inline with each other and perpendicular to the base platform. A first end of the third frame section 22 is connected via the third pair of latches to an end of the second frame section 16. A distal second end of the third frame section 22 is unsupported. An example use of the second end of the third frame section 22 can be as a pull-up bar.

Figure 5:
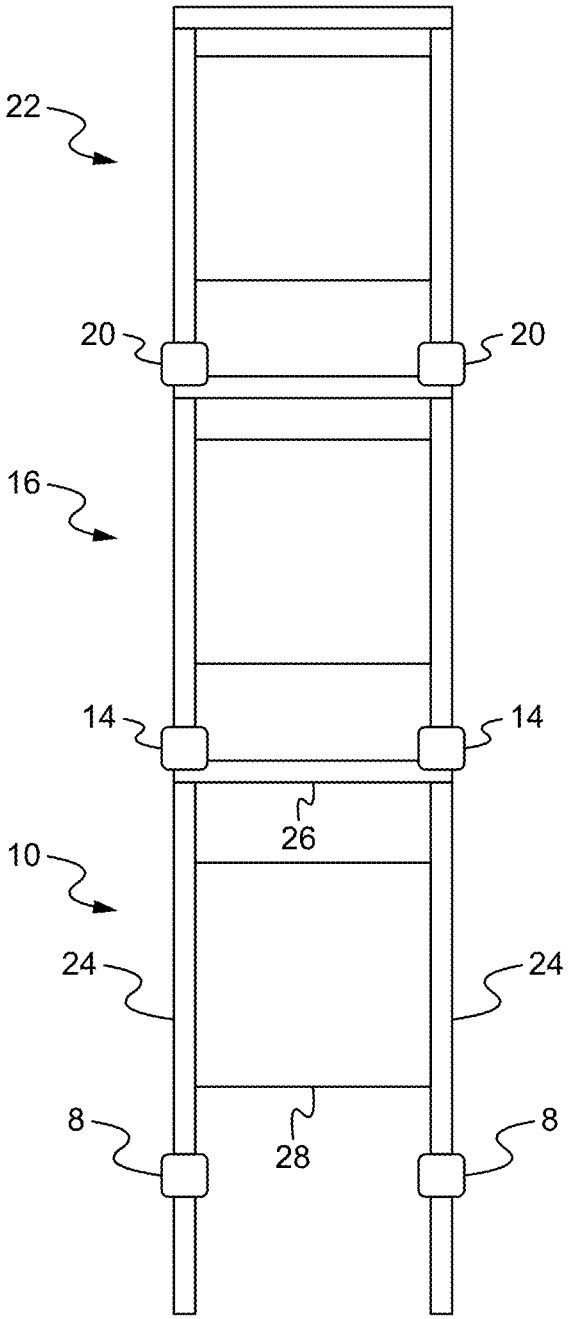
FIG. 5 illustrates a side view of the frame according to some embodiments.
Figure 6:
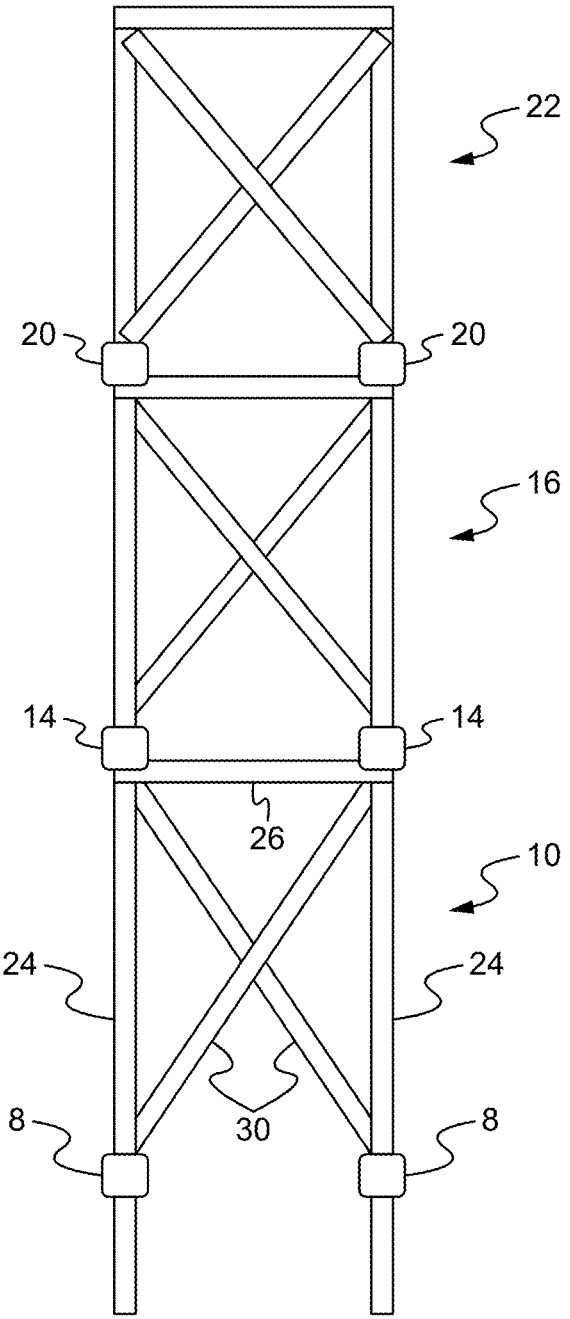
FIG. 6 illustrates a side view of the frame according to other embodiments.

Various configurations can be used to provide lateral stability to the frame sections. FIG. 5 illustrates a side view of the frame according to some embodiments. The view shown in FIG. 5 is rotated 90 degrees about vertical axis from the view shown in FIGS. 1-4. The frame configuration shown in FIG. 5 has the first frame section 10 including vertical supports 24 and horizontal support 26. A planar support sheet 28, such as a metal sheet, connects the vertical supports 24. The second frame section 16 and the third frame section 22 can be similarly configured. Each member 24, 26, 28 of each frame section can be configured with one or more fastener sites, as described in greater detail below, that enable connection of resistance bands or other accessories. Alternatively to the planar support sheet, a cross-bar configuration using cross-bars 30 can be used, as shown in FIG. 6. The cross-bars 30 also can be configured with one or more fastener sites. It is understood that alternative configurations can be used to provide lateral stability to the frame and frame sections.

Figure 7:
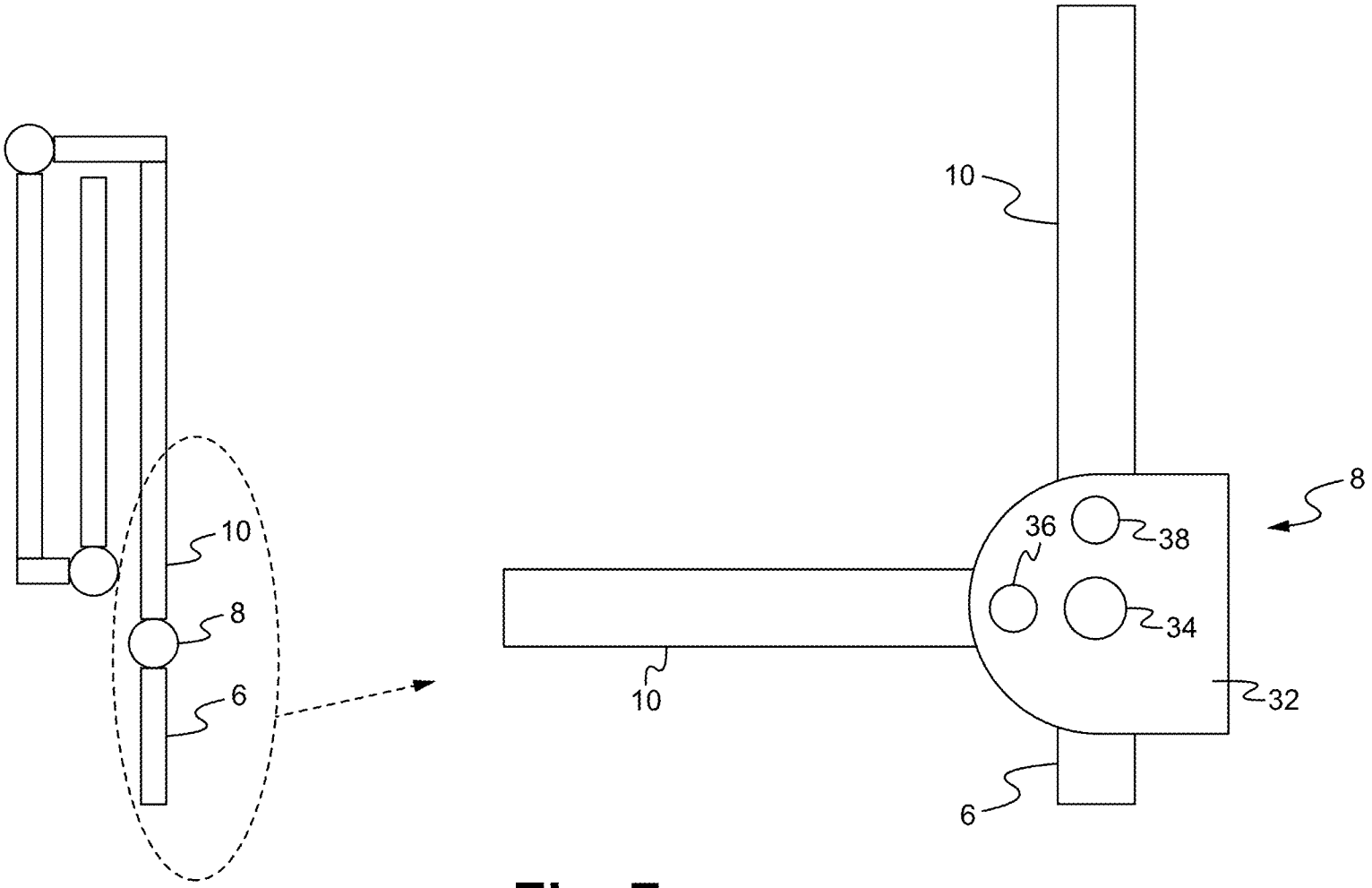
FIG. 7 illustrates a side view of the frame and an expanded view of the hinge assembly used to connect the base platform to the first frame section according to some embodiments.
Figure 8:
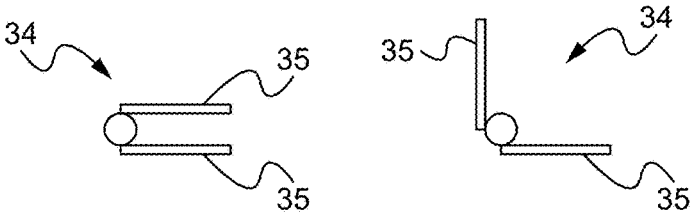
FIG. 8 illustrates an exemplary hinge having two leafs that can be rotated relative to each other according to some embodiments.
Figure 9:
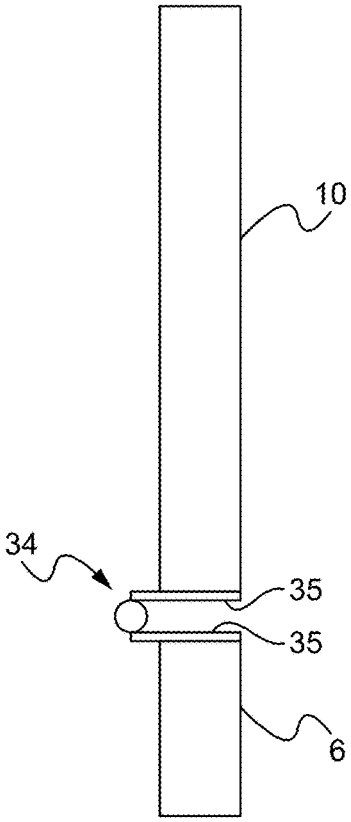
FIG. 9 illustrates the hinge where the first frame section is rotated to the second position.
Figure 10:
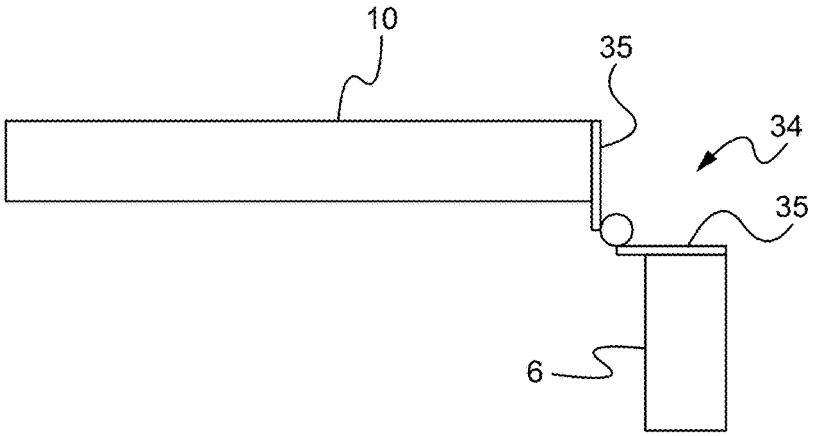
FIG. 10 illustrates the hinge where the first frame section is rotated to the first position.

In general, the hinge assemblies are of any type capable of folding and unfolding the base platform and frame sections, as well as locking and un-locking the frame sections in various positions, as described above. The specific types of hinge assemblies used for each interconnection point can vary depending on the degrees of movement and the various locking positions intended. FIG. 7 illustrates a side view of the frame and an expanded view of the hinge assembly used to connect the base platform 6 to the first frame section 10 according to some embodiments. FIG. 7 shows two different possible locked positions for the first frame section 10. A first position corresponds to a folded configuration, such as that shown in FIG. 1. The first position corresponds to the horizontally aligned first frame section 10 shown in FIG. 7. A second position corresponds to an unfolded configuration, such as those shown in FIGS. 2-4. The second position corresponds to the vertically aligned first frame section 10 shown in FIG. 7. The exemplary hinge assembly 8 includes a mounting plate 32 and a hinge 34. The hinge 34 enables the first frame section 10 to rotate relative to the mounting frame section 6. The hinge 34 can be configured as any conventional type of hinge that enables such relative movement, such as a barrel hinge that includes a pin, knuckles, and leafs. The mounting plate 32 includes through-holes 36 and 38, which when properly aligned with a corresponding through-hole in the first frame section 10 enable a pin to be inserted to lock the first frame section 10 in the first position or the second position, respectively. The mounting plate 32 is shown as a semicircle on one side and a rectangle on the other side. It is understood that alternative configurations can be used. The mounting frame section 6 is fixedly mounted to the mounting plate 32, such as by welding. The hinge 34 is fixedly mounted to the mounting frame section 6 and to the first frame section 10, such as by welding. FIG. 8 illustrates an exemplary hinge having two leafs 35 that can be rotated relative to each other. One leaf 35 can be fixedly mounted to the mounting frame section 6 and the other leaf 35 can be fixedly mounted to first frame section 10. FIG. 9 illustrates the hinge 34 where the first frame section 10 is rotated to the second position. FIG. 10 illustrates the hinge 34 where the first frame section 10 is rotated to the first position.

Figure 11:
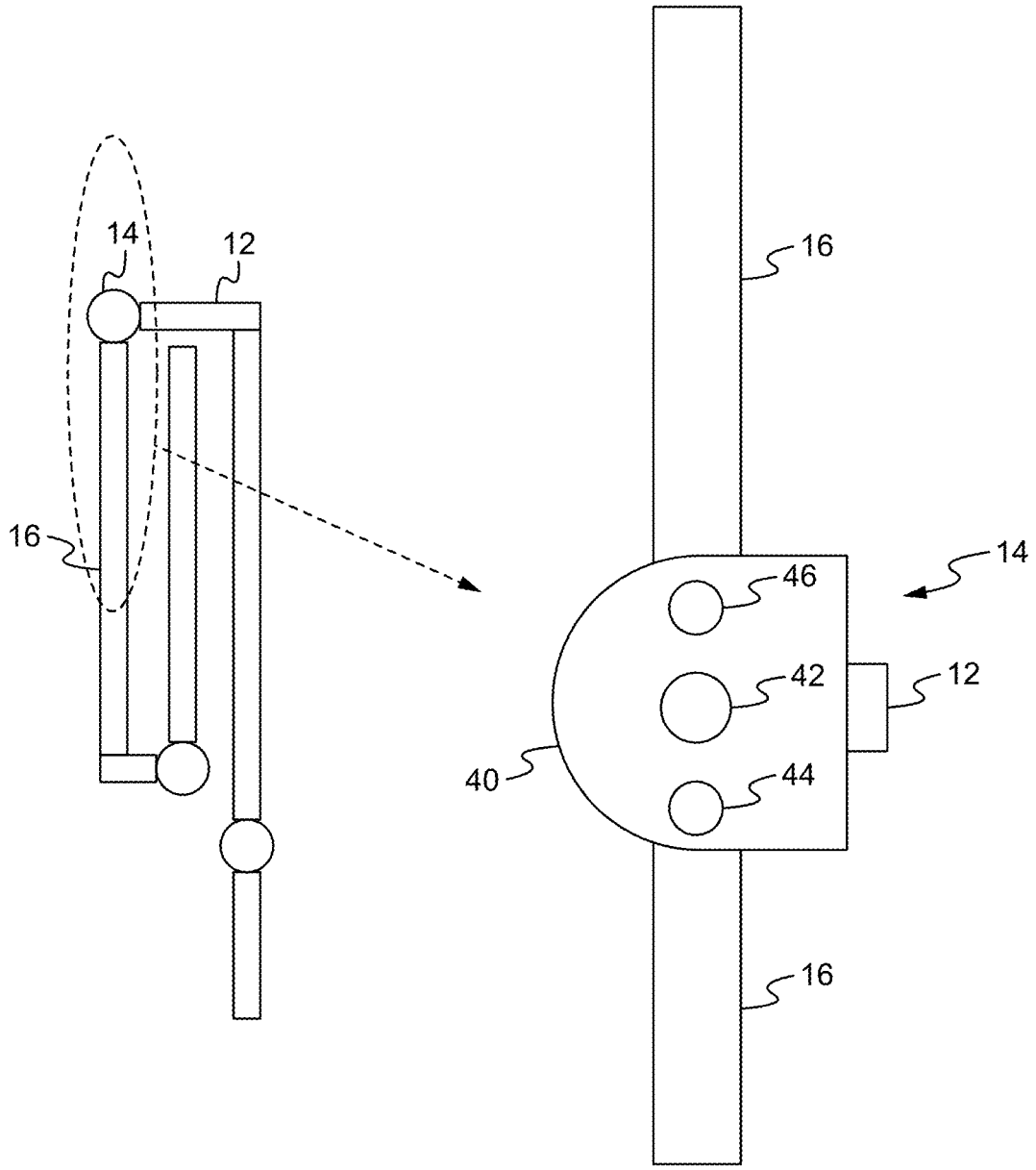
FIG. 11 illustrates a side view of the frame and an expanded view of the hinge assembly used to connect the first frame section to the second frame section according to some embodiments.
Figure 12:
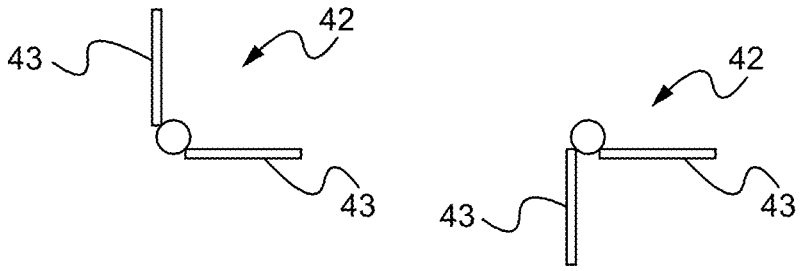
FIG. 12 illustrates an exemplary hinge having two leafs that can be rotated relative to each other.
Figure 13:
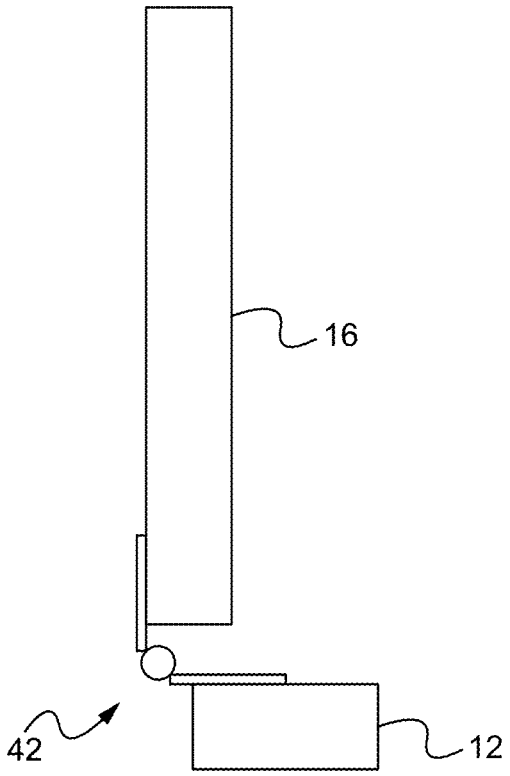
FIG. 13 illustrates the hinge where the second frame section is rotated to the second position.
Figure 14:
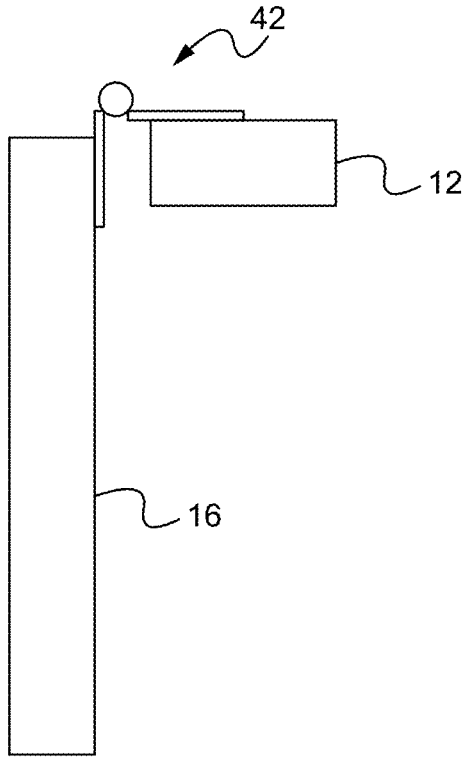
FIG. 14 illustrates the hinge where the second frame section is rotated to the first position.

FIG. 11 illustrates a side view of the frame and an expanded view of the hinge assembly used to connect the first frame section 10 to the second frame section 16 according to some embodiments. FIG. 11 shows two different possible locked positions for the second frame section 16. A first position corresponds to a folded configuration, such as that shown in FIGS. 1-2. The first position corresponds to the lower second frame section 16 shown in the right hand side of FIG. 11. A second position corresponds to an unfolded configuration, such as those shown in FIGS. 3-4. The second position corresponds to the upper second frame section 16 shown in the right hand side in FIG. 11. The exemplary hinge assembly 14 includes a mounting plate 40 and a hinge 42. The hinge 42 enables the second frame section 16 to rotate relative to the mounting frame section 12. The hinge 42 can be configured as any conventional type of hinge that enables such relative movement, such as a barrel hinge that includes a pin, knuckles, and leafs. The mounting plate 40 includes through-holes 44 and 46, which when properly aligned with a corresponding through-hole in the second frame section 16 enable a pin to be inserted to lock the second frame section 16 in the first position or the second position, respectively. The mounting plate 40 is shown as a semi-circle on one side and a rectangle on the other side. It is understood that alternative configurations can be used. The mounting frame section 12 is fixedly mounted to the mounting plate 40, such as by welding. The hinge 42 is fixedly mounted to the mounting frame section 12 and to the second frame section 16, such as by welding. FIG. 12 illustrates an exemplary hinge having two leafs 43 that can be rotated relative to each other. One leaf 43 can be fixedly mounted to the mounting frame section 12 and the other leaf 35 can be fixedly mounted to second frame section 16. FIG. 13 illustrates the hinge 42 where the second frame section 16 is rotated to the second position. FIG. 14 illustrates the hinge 42 where the second frame section 16 is rotated to the first position.

Figure 15:
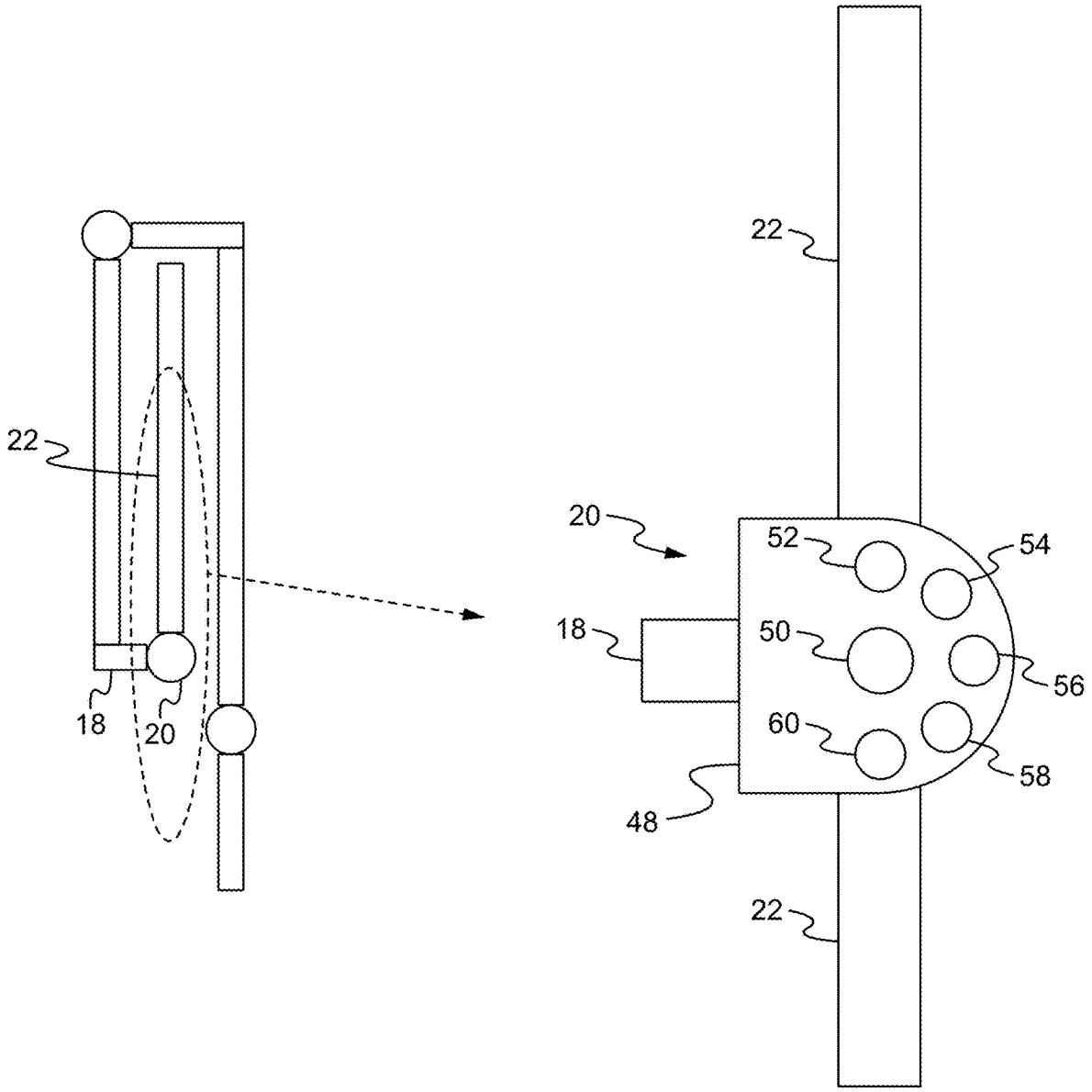
FIG. 15 illustrates a side view of the frame and an expanded view of the hinge assembly used to connect the second frame section to the third frame section according to some embodiments.
Figure 16:
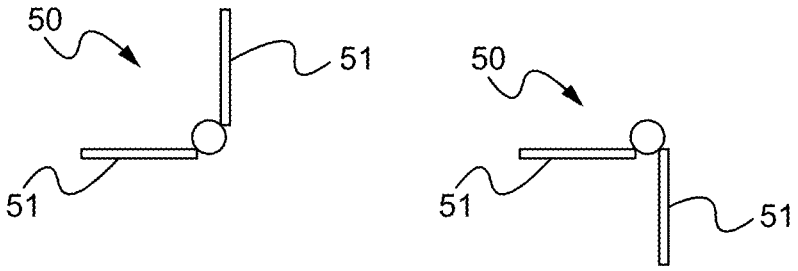
FIG. 16 illustrates an exemplary hinge having two leafs that can be rotated relative to each other.
Figure 17:
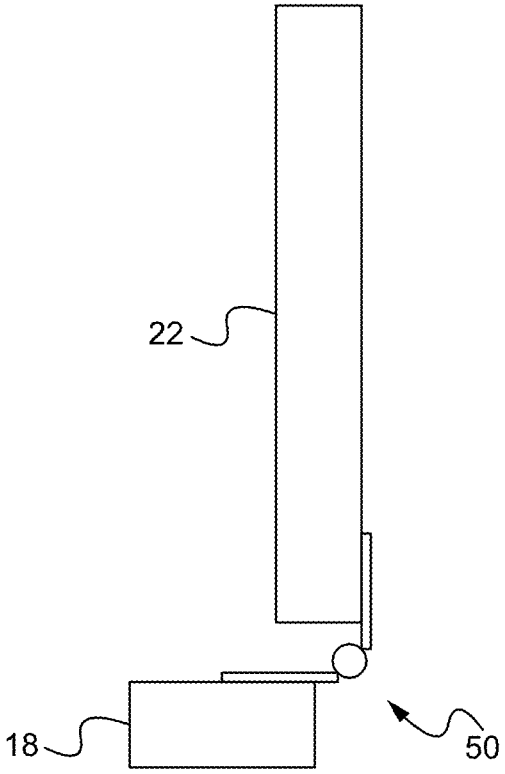
FIG. 17 illustrates the hinge where the third frame section is rotated to the first position.
Figure 18:
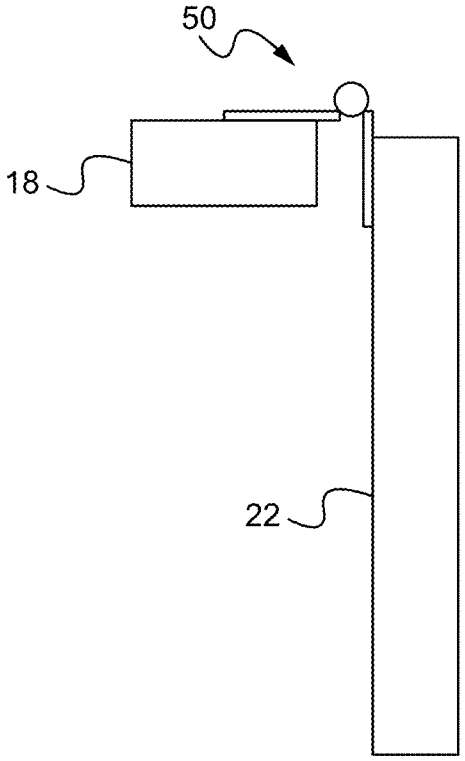
FIG. 18 illustrates the hinge where the third frame section is rotated to the second position.

FIG. 15 illustrates a side view of the frame and an expanded view of the hinge assembly used to connect the second frame section 16 to the third frame section 22 according to some embodiments. FIG. 15 shows two different possible locked positions for the third frame section 22. A first position corresponds to a folded configuration, such as that shown in FIGS. 1-3. The first position corresponds to the upper third frame section 22 shown in the right hand side of FIG. 11. A second position corresponds to an unfolded configuration, such as those shown in FIGS. 3-4. The second position corresponds to the lower third frame section 22 shown in the right hand side in FIG. 11. The exemplary hinge assembly 20 includes a mounting plate 48 and a hinge 50. The hinge 50 enables the third frame section 22 to rotate relative to the mounting frame section 18. The hinge 50 can be configured as any conventional type of hinge that enables such relative movement, such as a barrel hinge that includes a pin, knuckles, and leafs. The mounting plate 48 includes through-holes 52 and 60, which when properly aligned with a corresponding through-hole in the third frame section 22 enable a pin to be inserted to lock the third frame section 22 in the first position or the second position, respectively. The mounting plate 48 includes additional through-holes 54, 56, and 58 to enable the third frame section 22 to be locked into other positions other than the first and second positions. The mounting plate 48 is shown as a semi-circle on one side and a rectangle on the other side. It is understood that alternative configurations can be used. The mounting frame section 18 is fixedly mounted to the mounting plate 48, such as by welding. The hinge 50 is fixedly mounted to the mounting frame section 18 and to the third frame section 22, such as by welding. FIG. 16 illustrates an exemplary hinge having two leafs 51 that can be rotated relative to each other. One leaf 51 can be fixedly mounted to the mounting frame section 18 and the other leaf 51 can be fixedly mounted to third frame section 22. FIG. 17 illustrates the hinge 50 where the third frame section 22 is rotated to the first position. FIG. 18 illustrates the hinge 48 where the third frame section 22 is rotated to the second position.

In some embodiments, the hinge assemblies are configured to provide multiple securing and stabilizing mechanisms. A first mechanism locks the attached frame sections in their proper relative positions, e.g. each frame section has corresponding holes that, when properly aligned, enable a bolt to slide through the aligned holes in each piece, as described above. This bolt can be attached to a spring-loaded mechanism. To enable ease of use, a certain amount of slack is provided using the first mechanism, e.g. the bolt diameter is slightly smaller than the holes in the aligned frame section and hinge assembly. A second mechanism, such as a tensioning clamp, takes up any slack afforded by the first mechanism to form a rigid alignment of the frame section and hinge assembly. The first and second mechanism can be collectively considered a latch, such as latch used in the first second, and third pair of latches previously described.

Figure 27:
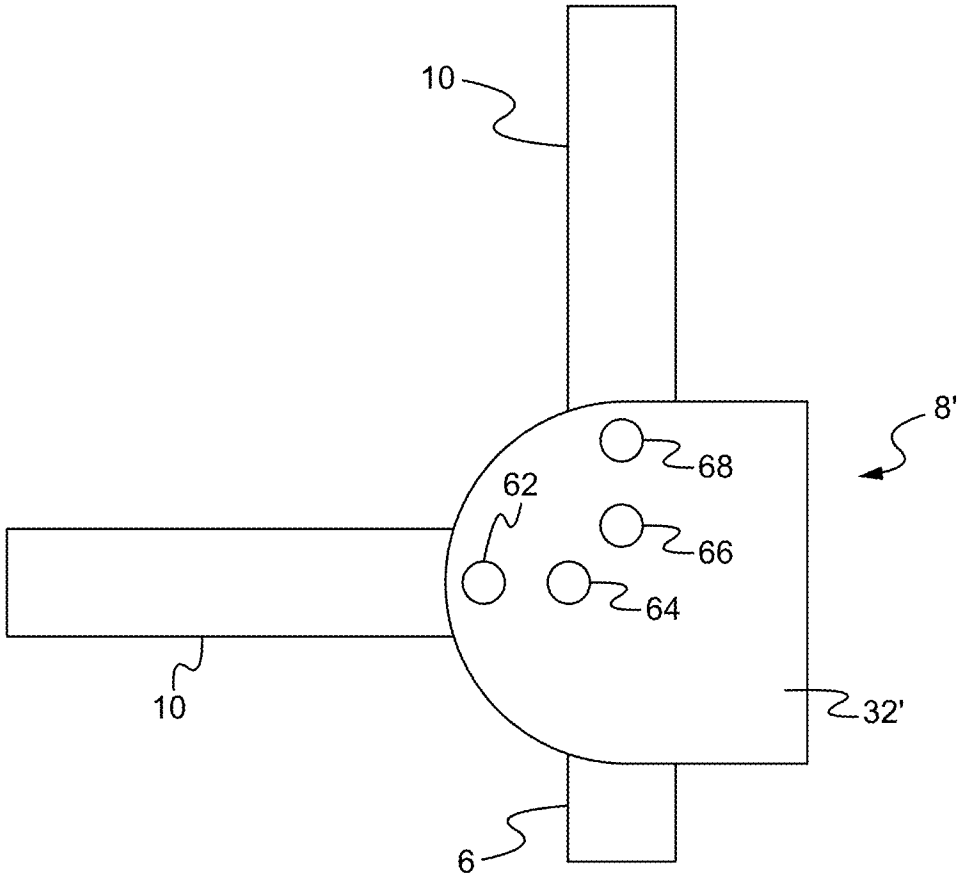
FIG. 27 illustrates a side view of the frame and an expanded view of a hinge assembly used to connect the base platform to the first frame section according to other embodiments.
Figure 27:
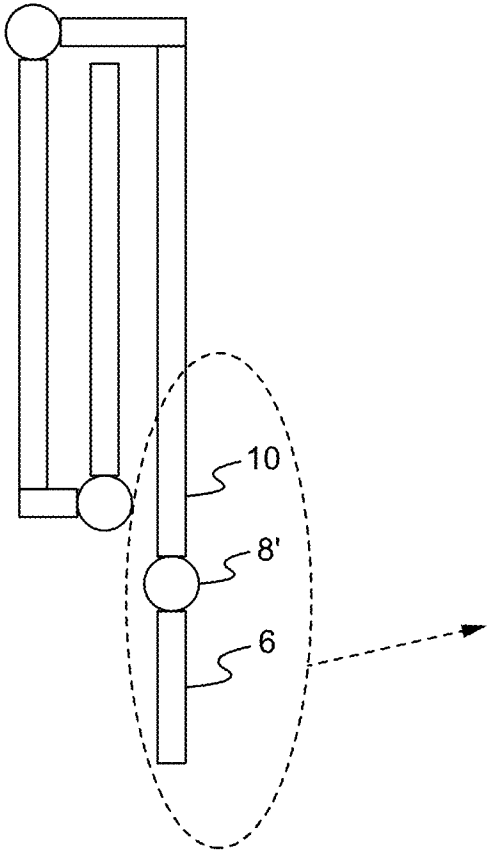

As used herein, a hinge assembly is a structure that enables ends of two frame sections, or the base platform and the first frame section, to be joined together and rotated relative to each other. In the previous embodiments, hinge assemblies are shown that fixedly couple the corresponding frame sections and/or base platform. As previously described, it is understood that alternative hinge assemblies are also contemplated. One such alternative is a hinge assembly that does not utilize a hinge with leafs to which the frame sections/base platform are attached. FIG. 27 illustrates a side view of the frame and an expanded view of a hinge assembly used to connect the base platform to the first frame section according to other embodiments. FIG. 27 shows two different possible locked positions for the first frame section 10. A first position corresponds to the folded configuration, such as that shown in FIG. 1. The first position corresponds to the horizontally aligned first frame section 10 shown in FIG. 27. A second position corresponds to the unfolded configuration, such as those shown in FIGS. 2-4. The second position corresponds to the vertically aligned first frame section 10 shown in FIG. 27. The exemplary hinge assembly 8' includes amounting plate 32'. The mounting plate 32' is configured to enable the first frame section 10 to rotate relative to the mounting frame section 6. The mounting plate 32' includes through-holes 62-64 and 66-68, which when properly aligned with corresponding through-holes in the first frame section 10 enable pins to be inserted to lock the first frame section 10 in the first position or the second position, respectively. The mounting plate 32' is shown as a semi-circle on one side and a rectangle on the other side. It is understood that alternative configurations can be used. The mounting frame section 6 is fixedly mounted to the mounting plate 32', such as by welding. However, the first frame section 10 is not fixedly coupled, such as welded, to the mounting plate 32'. In this sense, the first frame section 10 can be considered "free-floating" relative to the mounting plate 32'. To change from the first position to the second position the pins in the through-holes 62 and 64 are removed, the first frame section 10 is rotated to the second position, and the pins are inserted into the through-holes 66 and 68. Similar procedure is performed for changing from the second position to the first position. The mounting plate 32' can include channels, slots, sleeves, stops, and/or the like to prevent the ends of the first frame section 10 from separating from the mounting plate 32' while the pins are removed. It is understood that this alternative hinge assembly, or similar, can be used for some or all of the other hinge assemblies in the base structure.

Figure 19A:
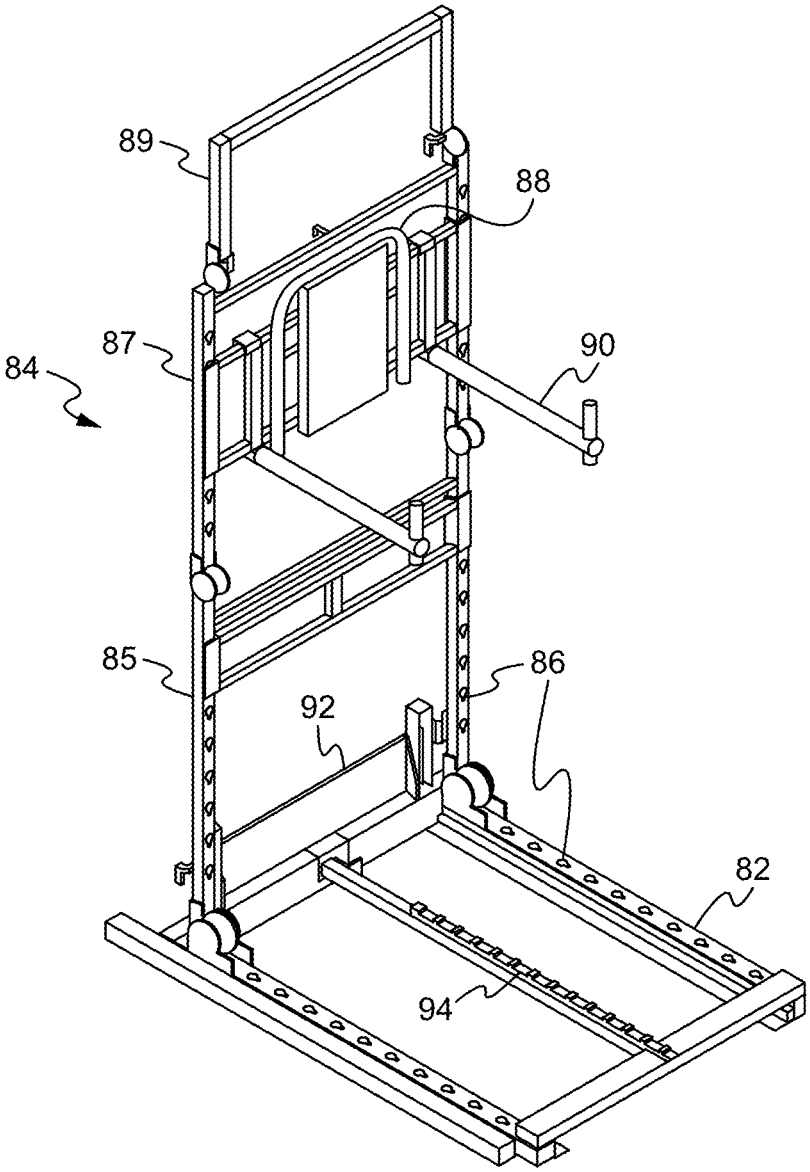
FIGS. 19A-C illustrates a perspective view of an exercise equipment in an unfolded configuration according to some embodiments.
Figure 19B:
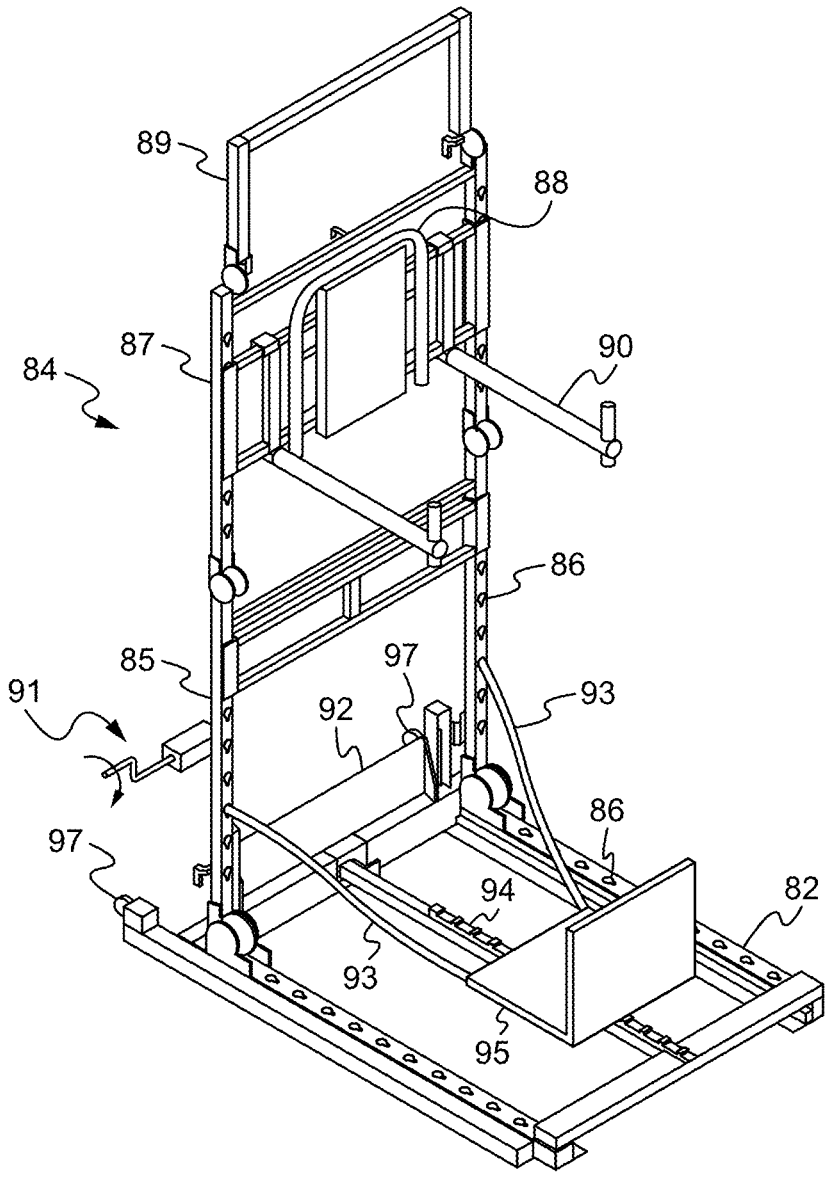
Figure 19C:
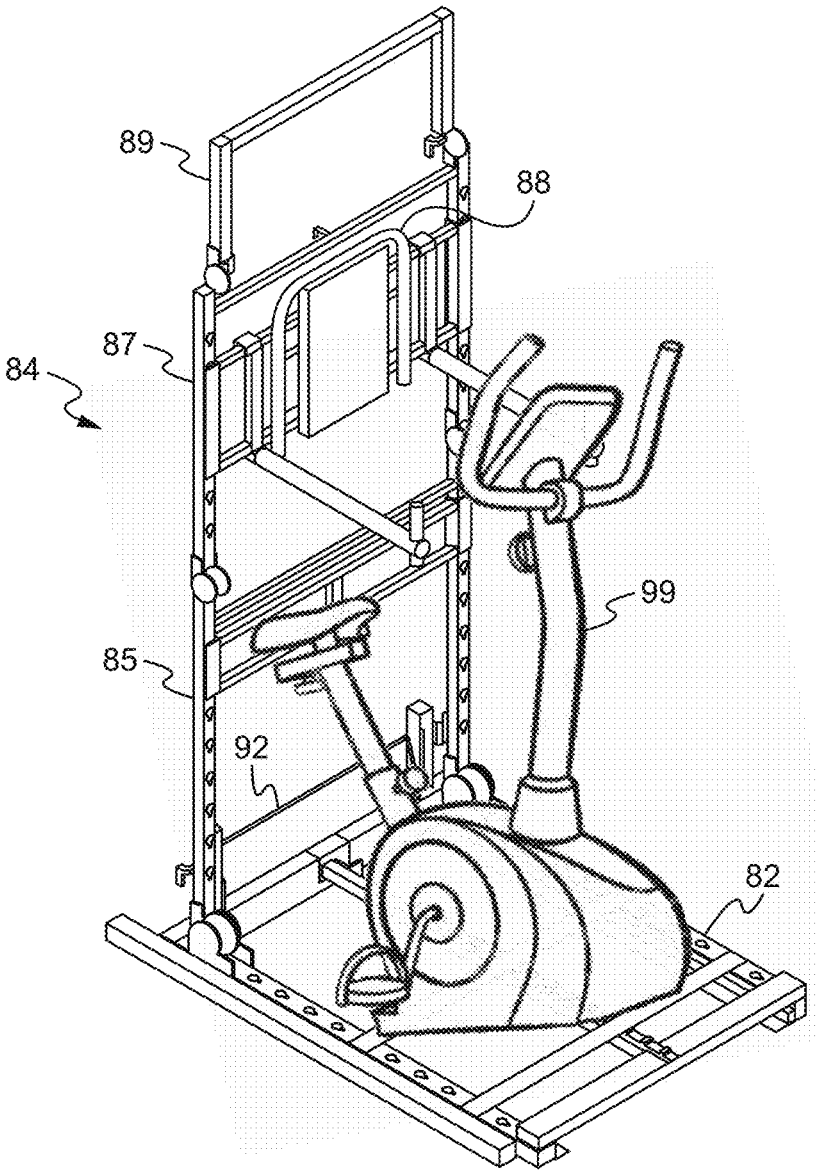

FIGS. 19A-C illustrate a perspective view of an exercise equipment in an unfolded configuration according to some embodiments. The exercise equipment shown in FIG. 19A includes a base structure of the type previously described. FIG. 19B shows the exercise equipment in FIG. 19A with a crankshaft 91 and several accessories attached. It will be appreciated that the crankshaft 91 is optional and may not be necessary where the exercise equipment is lightweight. The base structure includes a base platform 82 and a frame 84. FIG. 19C shows the exercise equipment in FIG. 19A configured with a stationary bike 99. Referring to FIG. 19A, the frame 84 includes a first frame section 85, a second frame section 87, and a third frame section 89. Each of the base platform 82, the first frame section 85, and the second frame section 87 include fastener sites 86. The third frame section 89 can also include fastener sites. In some embodiments, the base platform 82 includes a rigid rail structure positioned around a perimeter of the base platform, with the fastener sites included as part of the rail structure. As shown in FIG. 19A, the base platform 82 has the rigid rail structure formed around three sides of a solid planar substrate. The rigid rail structure is not placed at a fourth side of the solid planar substrate distal from the frame. This enables the solid planar substrate to be slidably moved relative to the rigid rail structure. In other embodiments, the rigid rail structure circumnavigates all four sides of the solid planar substrate. In this alternative case, the rigid rail structure can be configured to enable the solid planar substrate to be slidable. The exercise equipment is also shown in FIG. 19A as having a back rest board accessory 88 attached to the second frame section 87 via multiple fastener sites 86, a footplate accessory 92 attached to the first frame section 85 via multiple fastener sites, and a sliding seat mounting accessory 94 attached to the base platform 82 via multiple fastener sites. Some accessories can also be configured for additional accessories to be mounted. For example, arm bar accessories 90 are attached to the back rest board accessory 88 to perform, for example, leg raises or bar dips. The back rest board accessory can be positioned at lower fastener sites to perform, for example, wall squats. It is understood that more, or less, accessories than those shown in FIG. 19A can be attached to the base structure.

As explained in more detail below, in some embodiments, a user can use the seat arrangement 95 for leg presses. These embodiments advantageously eliminate the need for having a seat on the bicycle 99. In other embodiments, the bicycle 99 can be mounted to the vertical post (e.g., two or more frame sections when exercise equipment is in an unlocked configuration, with the frame sections perpendicular to the base platform) in a manner that positions the pedals for the bicycle 99 "straight in front" of the seat. In such a case, the flywheel and resistance element of the bicycle will be mounted above the pedals and will be attached to the vertical post.

In some embodiments, there is a spring-loading mechanism to assist in folding and unfolding the base structure. The frame sections have sufficient mass to provide stability and rigidity, but the increased weight may result in difficultly folding and unfolding the base structure. A first spring-loaded mechanism, at hinge 8 for example, can be attached to both the base platform and the first frame section to assist in the folding and unfolding process. A second spring-loaded mechanism, at hinge 14 for example, can be attached to both the first frame section and the second frame section for similar assistance. In some embodiments, as shown in FIG. 19B, a crankshaft 91 can be attached to a folded base structure stored in a vertical position that enables the folded base structure to be easily lowered to a horizontal position. In some embodiments, again referring to FIG. 19B, wheels 97 are coupled to the base platform 82. As explained in more detail below, in some embodiments, the exercise equipment can be stored vertically. Once folded, there are "small legs" that are tilted slightly to move the center of mass of the exercise equipment backward, thereby allowing the exercise equipment to be folded up and stored in the vertical position.

Figure 20:
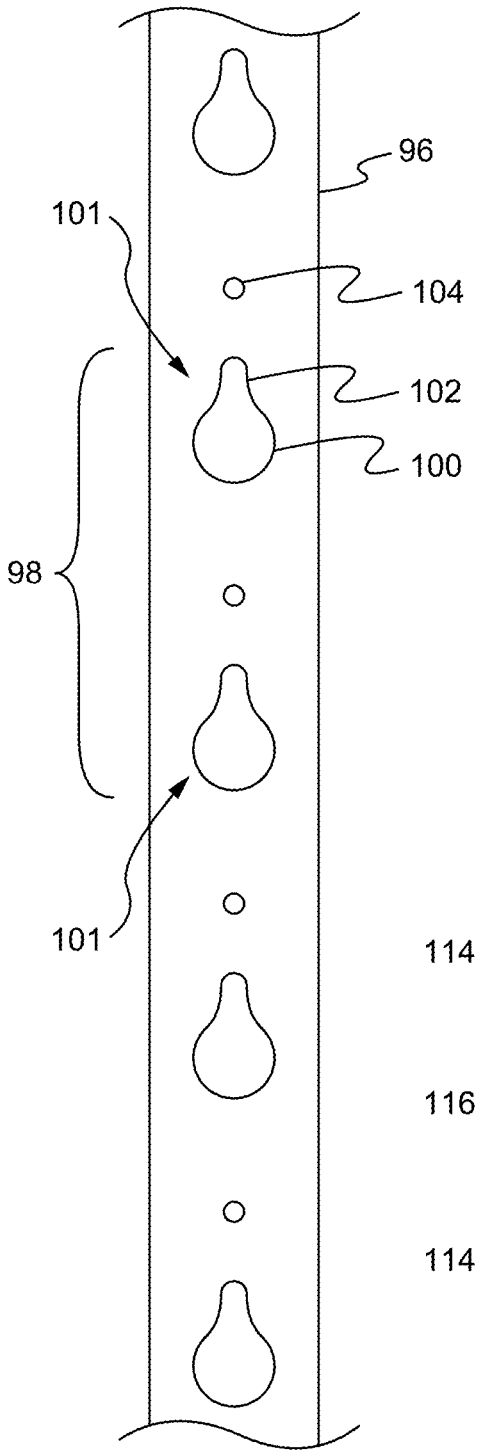
FIG. 20 illustrates a top down view of a section of the base platform or frame including a plurality of exemplary fastener sites according to some embodiments.

The base platform and the frame are each configured with multiple fastener sites, at each of which can be removably attached a fastener. There are a variety of different types of accessories that can be attached to the base structure via the fasteners. In some embodiments, each fastener site includes a slotted opening into which a corresponding fastening protrusion, such as a knob, hook, or the like, of a fastener is fitted and locked into place. Each fastener includes one or more fastening protrusions on one side for mating to the fastener site, and also includes an accessory fastener on an opposing side that enables attachment of an accessory having a complementary fastener element. FIG. 20 illustrates a top down view of a section of the base platform or frame including a plurality of exemplary fastener sites according to some embodiments. The base platform or frame 96 includes multiple fastener sites 98. Each fastener site 98 includes two openings 101 and a screw or pin hole 104. Each opening 101 includes an insert hole 100 for receiving a fastener protrusion and a slot 102 for sliding the received fastener protrusion into a secured position. The screw or pin hole 104 is configured to receive a fastener screw or pin for locking the fastener in the secured position.

Figure 21:
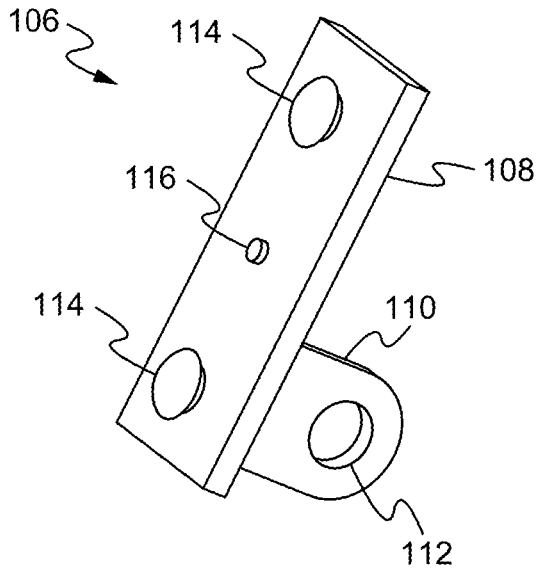
FIG. 21 illustrates a bottom perspective view of an exemplary fastener according to some embodiments.
Figure 22:
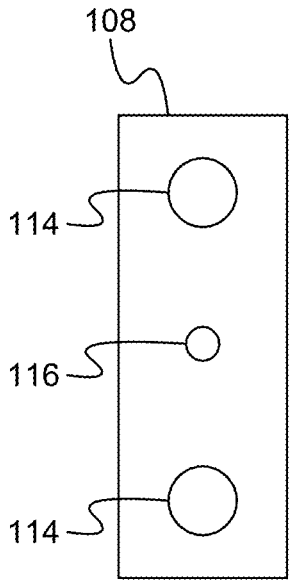
FIG. 22 illustrates a bottom up view of the fastener of FIG. 21.
Figure 23:
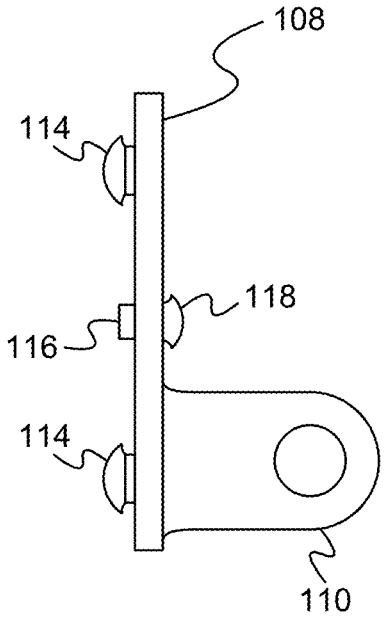
FIG. 23 illustrates a side view of the fastener of FIG. 21.

In an exemplary application, the fastener includes two fastening protrusion knobs and a screw or pin, the two fastening protrusion knobs for sliding into corresponding two slotted openings at a fastener site and the screw or pin for inserting into a corresponding screw or pin hole at the fastener site. The accessory fastener can be, for example, a protrusion with an eye hole opening to which a hook fastener can be attached. Other examples of an accessory fastener include, but are not limited to, an eye bolt or cleat. FIG. 21 illustrates a bottom perspective view of an exemplary fastener according to some embodiments. FIG. 22 illustrates a bottom up view of the fastener of FIG. 21. FIG. 23 illustrates a side view of the fastener of FIG. 21. The fastener 106 is configured to mate with the fastener site 98 of FIG. 20. The fastener 106 includes a fastener base 108 with fastener protrusions 114 and a screw or pin 116 on one side and an accessory fastener 110 on another side. The accessory fastener 110 includes an eye hole 112 enabling connection to an accessory having a complementary attachment means. For example, a resistance band can have a clamp or hook configured to attach at the eye hole 112. The screw or pin 116 includes a screw or pin knob 118 to enable screwing or insertion/removal of the screw or pin 116 into the screw or pin hole 104. It is understood that the accessory fastener 110 can be alternatively configured to mate with other types of accessory attachment configurations. It is also understood that the fastener can be integrally formed as part of the accessory, thereby eliminating the need for an accessory fastener. A fastener can be configured to include or provide coupling means for a pulley. In such configurations, multiple fasteners with pulleys can be attached to the base structure according to desired exercise configurations. In this case, resistance bands can be replaced by cables better adapted to work with pulleys.

In some embodiments, the pin 116 is replaced by a turnable handle that presses on a tongue that is the object 118. The tongue is then pressed onto the frame, creating a resistance to movement through this pressure and friction.

A variety of different types of accessories can be attached to the base structure, where each accessory can be attached at one or more fastener sites. Examples types of accessories include resistance bands, cables, chains, bars, and bars in combination with resistance bands, cables, and/or chains. Resistance bands come in various forms and configurations. One can obtain these as off the shelf products. Some have hooks on the end, in which case, these hooks can be used to attach the resistance bands to different positions on the base structure. Cables can be used to extend the reach of the resistance bands so that the proper distance can be maintained by the trainee without having to stretch the resistance bands. The cable in effect becomes an "extender" for the resistance band without having to stretch the resistance band to use it from a proper position on the base structure. Another adaptation is to have a hybrid resistance band where a section closest the user is a high strength cable, rope, or other non-elastic material and the remaining section is elastic, such as a resistance band. This provides an improved degree of safety such that if the resistance band portion were to snap, the user would be protected from the whipping action of the snapping resistance band. Pulleys/rollers can also be added to enable positioning of the resistance band section distal from the user, and positioning the non-elastic section proximate the user. Frame piece with fastener sites accessories can also be fastened to the base platform and/or the frame for additional fastener site positions.

Bars can be attached to the base structure at different fastener sites. The value here is that there are many exercises where one uses the body weight to perform the exercise. Examples are reverse push-ups, push-ups at different angles, pull-ups, etc. The base structure allows multiple connection points for the bar to position the trainee properly for performing these exercises. A bar in combination with resistance bands enables additional types of exercises. For example, reverse lat pulls are enabled by connecting the bar to a resistance band that hangs from the uppermost part of the base structure. A bar, or individual hand holds, can also be indirectly attached to the frame via cable, chain, or other non-elastic element. A slidable seat (e.g., 95, FIG. 19B) can be attached to the base platform or the collapsible frame by resistance bands 93, and a foot rest can be attached to the frame, resistance bands can be connected between the seat and the frame, or the foot rest, to perform seated leg press. The slidable seat and the foot rest are considered accessories attachable to the base structure. The slidable seat can also be used as part of a rowing configuration by further adding an "oar" accessory that can be a movable bar or other handle separately connected to the base structure via one or more resistance bands. In such a rowing configuration, tension bands can or cannot also be separately connected to the slidable seat. A bench press exercise can be performed by positioning a bench on the base platform (does not need to be connected at a fastener site) and attaching a bar to the base structure, e.g. to multiple fastener sites on the base platform, via one or more resistance bands connected at each end of the bar. Fasteners can be configured as barbell supports, such as hooks or racks, to enable the frame to function as a bench press rack, for example. Fasteners can also be configured as a step, which can also function as a seat or bench. As shown in FIG. 19C, a stationary bike 99 can be implemented by attaching a flywheel and seat to the base platform. Other forms of equipment can also be attached. Examples include, but are not limited to, treadmills, stair-master, etc. Many of these attachments, such as treadmills and stair-masters, can use the resistance element that is introduced by the stationary bike accessory. In all of these instances (treadmill or stair-master), the circular motion of the bike pedal can be translated into other types of motion that can be applied to the treadmill and stair-master. In general, the frame and base platform can provide the stability and ability to attach a number of accessories that have moving parts and would normally require a heavy base in order to be stable.

It will be appreciated that embodiments of the invention advantageously provide modularity and re-use of the modules for a variety of exercises, resulting in low cost, because of re-usability; lower space consumption; flexibility for the user to configure the exercise equipment as they wish; and flexibility for the user to buy what they need, to name only a few examples. In some embodiments, the exercise equipment is made primarily from metal, which can be salvaged or recycled, making the equipment more environmentally friendly.

In general, a bar or separate hand holds can be attached to the base platform or frame via one or more resistance bands to perform bench press exercise, incline bench press exercise, seated curl exercise, standing curl exercise, standing face pull exercise, bent over crossover exercise, triceps extension exercise, standing row exercise, leg lift exercise, back leg extension exercise, squat exercise, standing shoulder press exercise, shrug exercise, triceps push down exercise, one-arm triceps push down exercise, kneeling triceps push down exercise, lying triceps extension exercise, hamstring curl exercise, landmine press exercise, bent over row exercise, one-arm row exercise, inverted row exercise, dead lift exercise, triceps push down exercise, lateral raise exercise, face pull exercise, incline YTW exercise, shoulder shrug exercise, lat pull down exercise, overhead press exercise, clean and press exercise, incline bench press exercise, dumbbell curl exercise, hammer curl exercise, cross-body curl exercise, hang clean exercise, lunge exercise, Pilate exercises, torso twist exercise, banded and the like.

Examples of exercises that can be performed using non-elastic alternatives to the resistance bands include, but are not limited to, cable bent-over row exercise, good morning exercise, and a variety of body weight exercises including, but not limited to, fly exercise, reverse fly exercise, row exercise, assisted pushup exercise, and TRX pushups. Examples of exercises that can be used with the attached step (seat, bench) include, but are not limited to, assisted pushups with attached bench, triceps dip exercise on attached bench, stretching exercises, step up/down exercises, leg extension exercise with attached bench, and seated leg curls.

Since there are numerous fastener sites along the base platform and the frame, the attachment position of the accessories can be custom adjusted by the user. In some embodiments, the resistance bands can be length-adjustable to accommodate a desired range of motion and tension. In some embodiments, the resistance (strength) bands provide additional degrees of freedom that other force generators (weight set or motor) do not offer as easily. This is because the other force generators generally have one cable from which the force is distributed. In contrast, the resistance bands can offer multiple independent force vectors.

Figure 25:
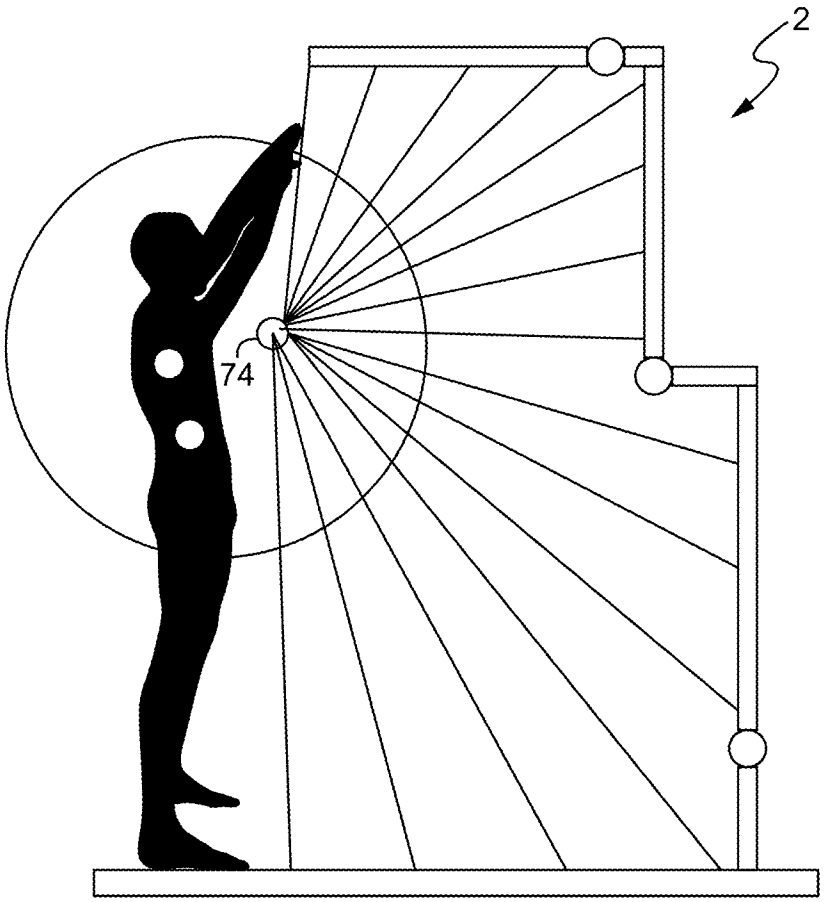
FIG. 25 illustrates various different exemplary attachment positions of resistance bands to the base structure according to an alternative accessory starting point.
Figure 24:
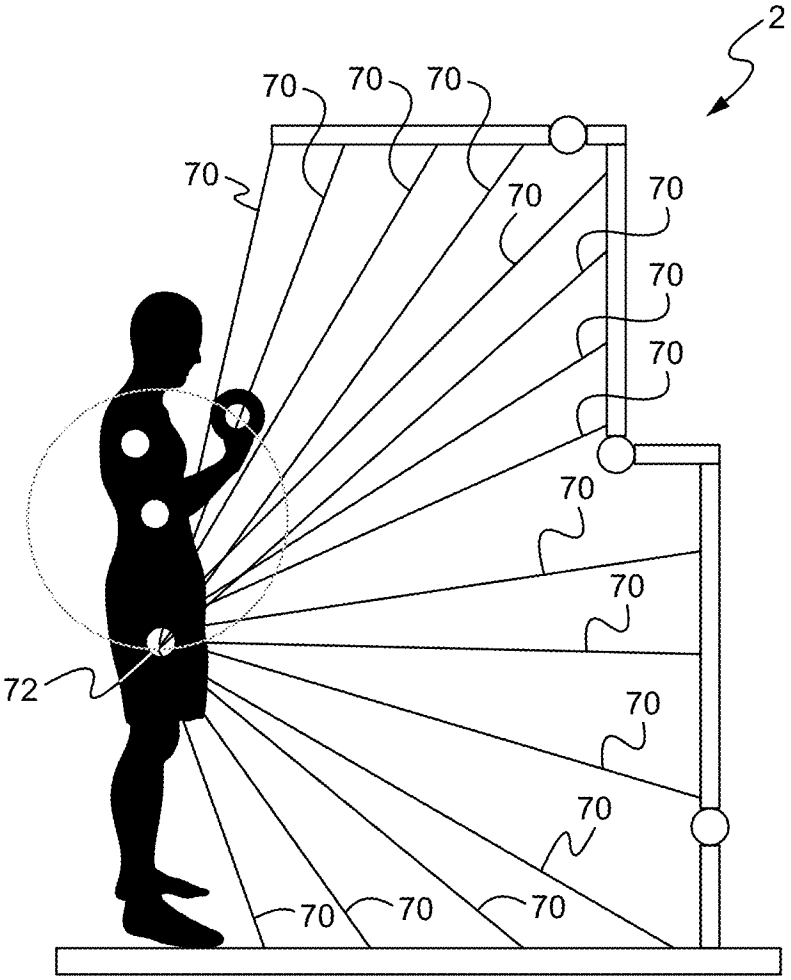
FIG. 24 illustrates various different exemplary attachment positions of resistance bands to the base structure for an accessory starting point.

FIG. 24 illustrates various different exemplary attachment positions of resistance bands 70 to the base structure 2. Assuming a starting exercise position at point 72, one or more resistance bands can be attached to the base structure 2 for performing a variety of different exercise motions and corresponding resistance. The types of resistance bands and attachment position(s) can be adapted depending on the starting position and type of exercise performed, such as alternative starting position 74 shown in FIG. 25. Multiple tension bands can be simultaneously attached between the base structure and an accessory, such as a bench press bar, at different angles to achieve multi-directional force and/or different resistance profiles.

The use of resistance bands enable the implementation of multi-directional force vectors, e.g multiple resistance bands attached to an accessory at different angles (all bands attached to the accessory at one end, but each different band is attached to a different fastener site). Multi-directional force vectors can be used to create exercises with new resistance angles relative to the body. Additionally, multi-directional force vectors can be used to increment/decrement the resistance force for the user performing the exercise in more precise resistance units due to the composite resistance force formed by the multiple different directions of the individual force vectors of each tension band. Pulleys or rollers can be used, e.g. a pulley/roller positioned at a first fastener site on the base platform, with the resistance band extending under the pulley/roller and then extending horizontally to be connected at another second fastener site. The position of the pulley fastener site can be adjusted to adjust the overall length between the first end of the resistance band connected to the exercise accessory, e.g. bench press bar, and the second end attached to the second fastener site. Lengthening the resistance band increases the resistance for the user performing the exercise, shortening the resistance band decreases the resistance.

Cams can also be used as accessories. Cams can have different types of profiles, each profile defining a force resistance profile for a cable wrapped about the cam profile with the cable attached to a resistance band. Similarly, there are motors that provide similar such force resistance profiles. As one example, shown in FIG. 26, a motor 3—can be adapted for attachment at the fastener sites, with a cable 5, having a handle 5A, extending from the motor 3 to be attachable to the motor 3, either directly or via one or more pulleys/rollers. The motor 3 regulates the torque, which in turn regulates the resistance experienced by the user.

Figure 26:
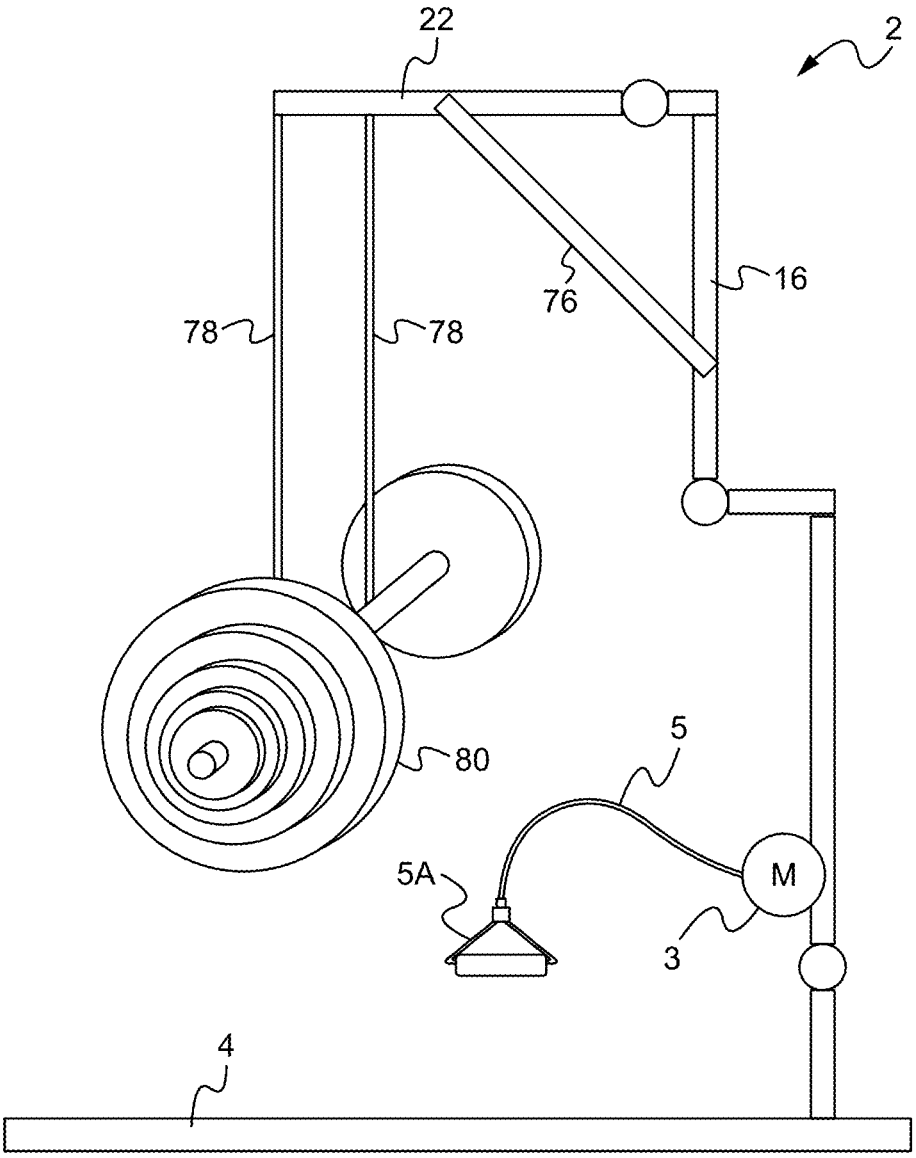
FIG. 26 illustrates the base structure with additional support member accessories according to some embodiments.

Accessories also can include additional support members for the base structure. FIG. 26 illustrates the base structure with additional support member accessories according to some embodiments. Support members 76 are connected between the frame section 16 and the frame section 22 and provide more weight bearing capability to the frame section 22. This additional support allows, for example, a heavier person to do pull-ups. With the additional support members 76 in place, the frame section 22 can also be fitted with support cords 78 of a pre-determined length that can be attached to a set of weights 80 that are being used for a military bench press, for example. The support cords can be adjusted in a manner that prevents the weights from pressing too hard on the chest of the weight-lifter. This result also applied to other forms of exercise where a heavy load is being lifted by the user and it is desired to limit the range of motion for the heavy load to better protect the user against injury. It is understood that alternatives to cords can be used including, but not limited to, chains, cables, or other non-elastic elements. Parallel vertical bars can be attached the frame section 22 and/or the base platform 4 to guide the weight set in a vertical direction movement. The additional support members can also be configured with fastener sites to further function as frame piece with fastener sites accessories.

Figure 28A:
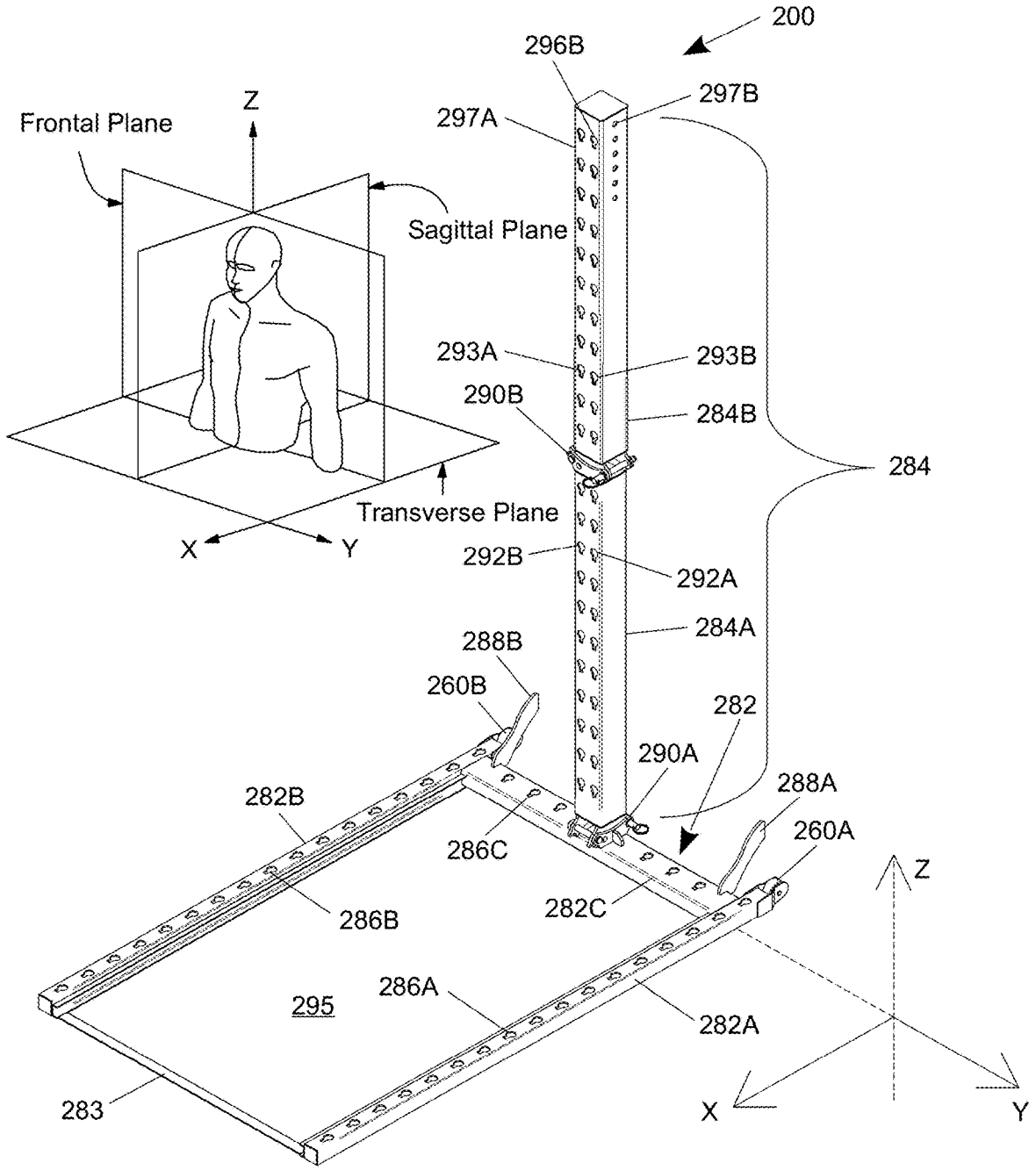
FIGS. 28A-H illustrate perspective views of exercise equipment in both unfolded and folded configurations in accordance with embodiments.

FIG. 28A shows a perspective view of a portion of exercise equipment 200 (base structure) in an unfolded position in accordance with some embodiments of the invention. As explained in more detail below, exercising accessories can be attached to fastener sites on the portion of the exercise equipment 200 shown in FIG. 28A. In some embodiments, the elements 288A, 288B, 260A, and 260B are optional and removable.

FIG. 28A shows an XYZ coordinate system to simplify the discussion merely for ease of explanation of some embodiments and is not intended to limit the scope of the invention. For example, the labeling of XYZ is arbitrary. FIG. 28A shows an exerciser (displaced from the workout platform 295 for ease of illustration), directly facing or directly facing away from the collapsible frame to define an XZ ("sagittal") plane, a YZ ("frontal") plane, and an XY ("transverse") plane. It will be appreciated that while FIG. 28 shows single XZ, YZ, and XY planes, the figure includes multiple planes, such as multiple sagittal planes parallel to the sagittal plane shown in the figure.

The exercise equipment 200 includes a base platform 282 supporting a collapsible frame 284. The base platform 282 includes two opposing strips 282A and 282B coupled by a cross strip 282C. In some embodiments, the strips 282A and 282B are parallel, and the cross strip 282C is perpendicular to both, though other configurations are possible. The base platform 282 includes a rigid rail structure 283 that runs along a perimeter of the strips 282A, 282B, and 282C. The base platform 282 also includes anti-tilt bars 288A and 288B, which prevent the exercise equipment 200 from tilting along the XZ plane, and wheels 260A and 260B. In some embodiments, the anti-tilt bars 288A and 288B are coupled to an edge of the cross strip 282C, and the wheels 260A and 260B are coupled to ends of the strips 282A and 282B, respectively. In some embodiments, the strips 282A, 282B, and 282C enclose three sides of an opening 295 which, as described below, is sized to accept the frame 284 when the exercise equipment 200 is in the folded/collapsed configuration for storage or transportation. In other embodiments, the opening 295 is replaced by a board or other flat structure configured to lie on a flat surface and to provide an area for an exerciser to stand, sit, squat, or otherwise position themselves while working out on the exercise equipment 200. The board or flat structure can be fixedly attached to the frame 282 in order to prevent it from slipping out during exercises.

The collapsible frame 284 includes first and second frame sections 284A and 284B, respectively, and first and second hinge assemblies 290A and 290B, respectively. The first hinge assembly 290A rotatably couples the base platform 282 to a proximal end (relative to the base platform 282) of the first frame section 284A at the cross strip 282C. The second hinge assembly 290B rotatably couples a distal end of the first frame section 284A to a proximate end of the second frame section 284B. It will be appreciated that other configurations are also contemplated. In some embodiments, the second hinge assembly 290B directly couples the first frame section 284A to the second frame section 284B, thereby providing a single pivot point between the two frame sections 284A and 284B.

Top surfaces of the first strip 282A, the second strip 282B, and the cross strip 282C all contain base platform fastener sites (e.g., 286A, 286B, and 286C, respectively). In some embodiments, each of the top surfaces of the first strip 282A, the second strip 282B, and the cross strip 282C contains multiple base platform fastener sites. In other embodiments, at least one of the top surfaces contains multiple base platform fastener sites.

In some embodiments, a front face of the first frame section 284A contains parallel columns of fastener sites 292A and 292B (e.g., in a frontal plane), and a front face of the second frame section 284B contains parallel columns of fastener sites 293A and 293B (e.g., also in the frontal plane). In some embodiments, opposing side faces of the second frame section 284B (e.g., in a sagittal plane) contain columns of opposing/paired fastener sites 297A and 297B. (While FIG. 28A shows fastener sites 297B, it will be appreciated that matched fastener sites 297B are included on the opposing side face of the second frame section 284B.)

When the exercise equipment 200 is in an unfolded configuration, an exercising accessory (e.g., separate pull up handles) can be concurrently attached to paired fastener sites 297A and 297B for exercising. Alternatively, the separate handles can be attached at offset fastener sites 297A and 297B (e.g., at different heights above the base platform 282) to exercise muscles in customized workouts.

Figure 28B:
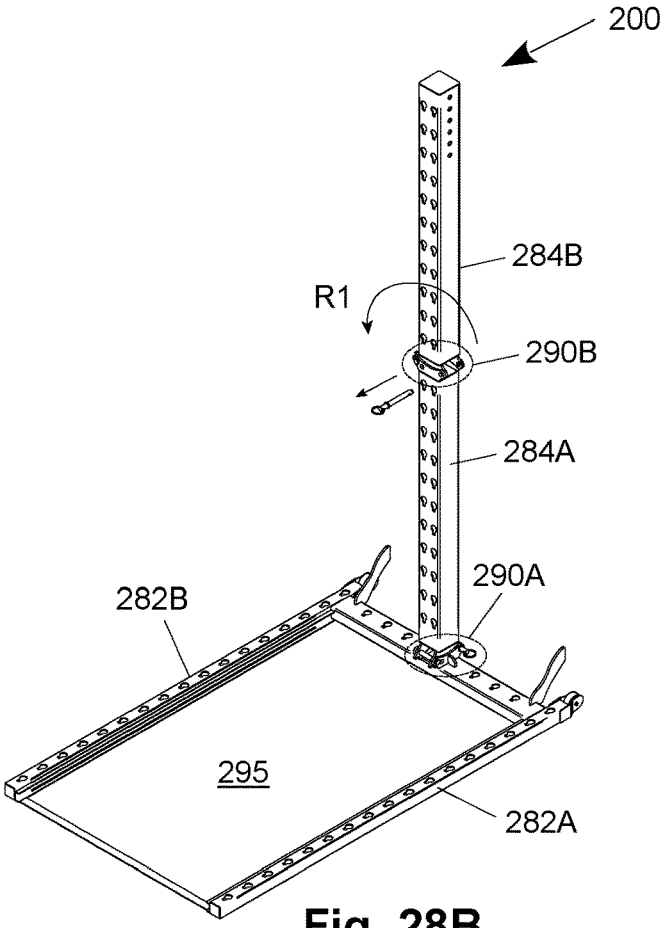
Figure 28C:
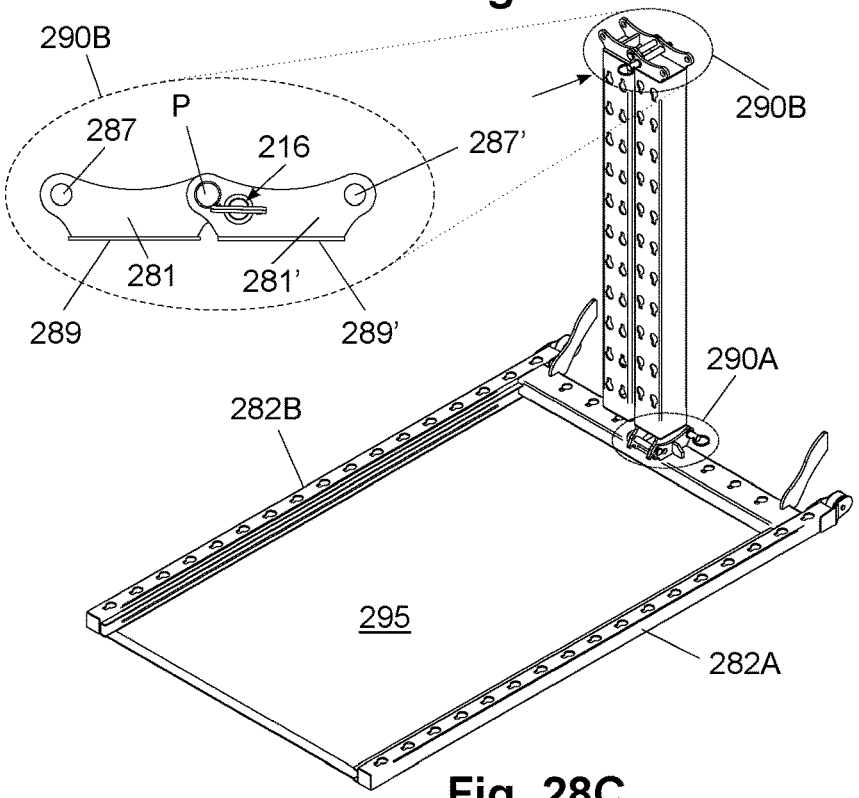

As shown in FIG. 28B, when the second hinge assembly 290B is unlocked, the second frame section 284B pivots substantially about the second hinge assembly 290B in a frontal plane (as shown by arrow R1), such that corresponding side faces of the first frame section 284A and the second frame section 284B are rotated relatively towards each other, thereby partially collapsing the exercise equipment 200, reducing its height and thus its volume. FIG. 28C shows the exercise equipment 200 after this rotation, in this partially folded configuration. FIG. 28C also shows a front cross section of the second hinge assembly 290B, showing a first hinge element 281 with an aperture 287, rotatably coupled about a pivot point P secured by pivot pin P' to a second hinge element 281', with an aperture 287'. When the apertures 287 and 287' are aligned, the first and second sections 284A and 284B are vertically aligned (e.g., stacked) as shown in FIG. 28A and can be locked in the unfolded configuration when a pin 216 is inserted through the aligned apertures 287 and 287'. FIG. 28C also shows that first and second hinge elements 281 and 281' have bottom surfaces or plates ("leafs," 289 and 289') for attaching to the ends of first and second sections 284B and 284A, respectively. It will be appreciated that while FIG. 28C shows elements 281 and 281', it will be appreciated that each element has a matching pair, as shown in FIG. 28G. FIG. 28C shows the exercise equipment 200 in the folded configuration, when the pin 216 is kept in a placement hole to prevent its loss or misplacement.

It will be appreciated that descriptions of a first element being rotated/folded relative to a second element encompasses the first element being rotated/folded relative to the second element, the second element being rotated/folded relative to the first element, or both elements being rotated/folded relative to each other.

Figure 28D:
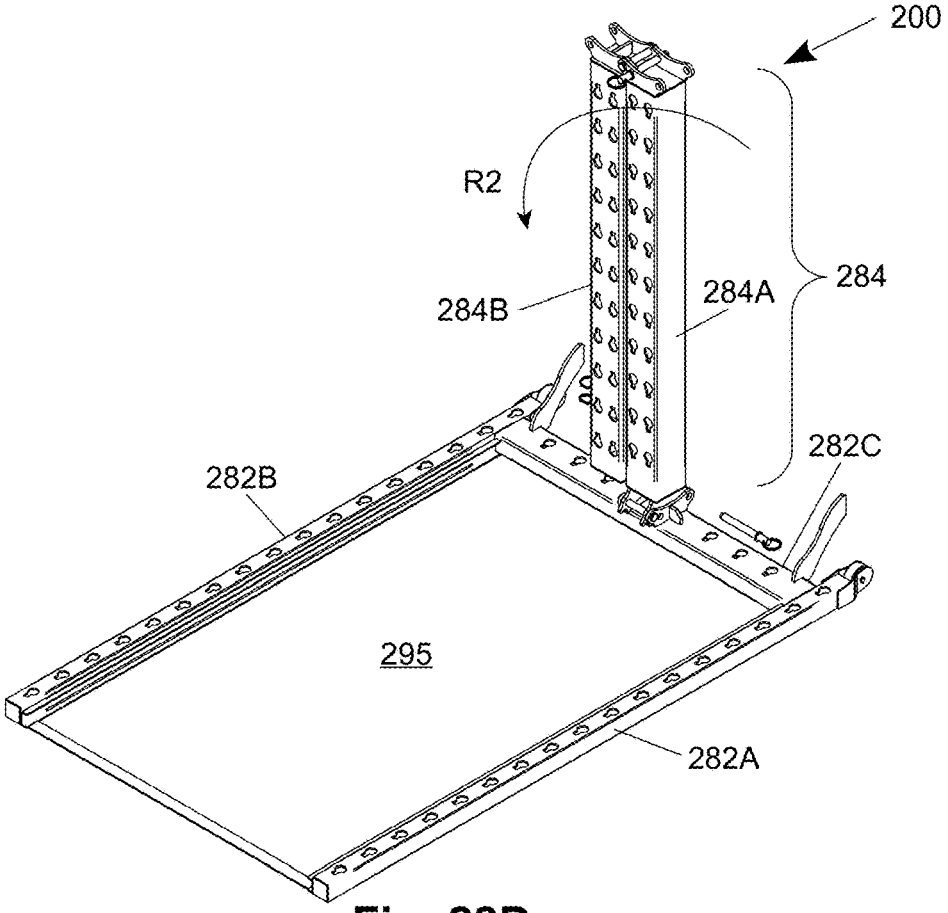
Figure 28E:
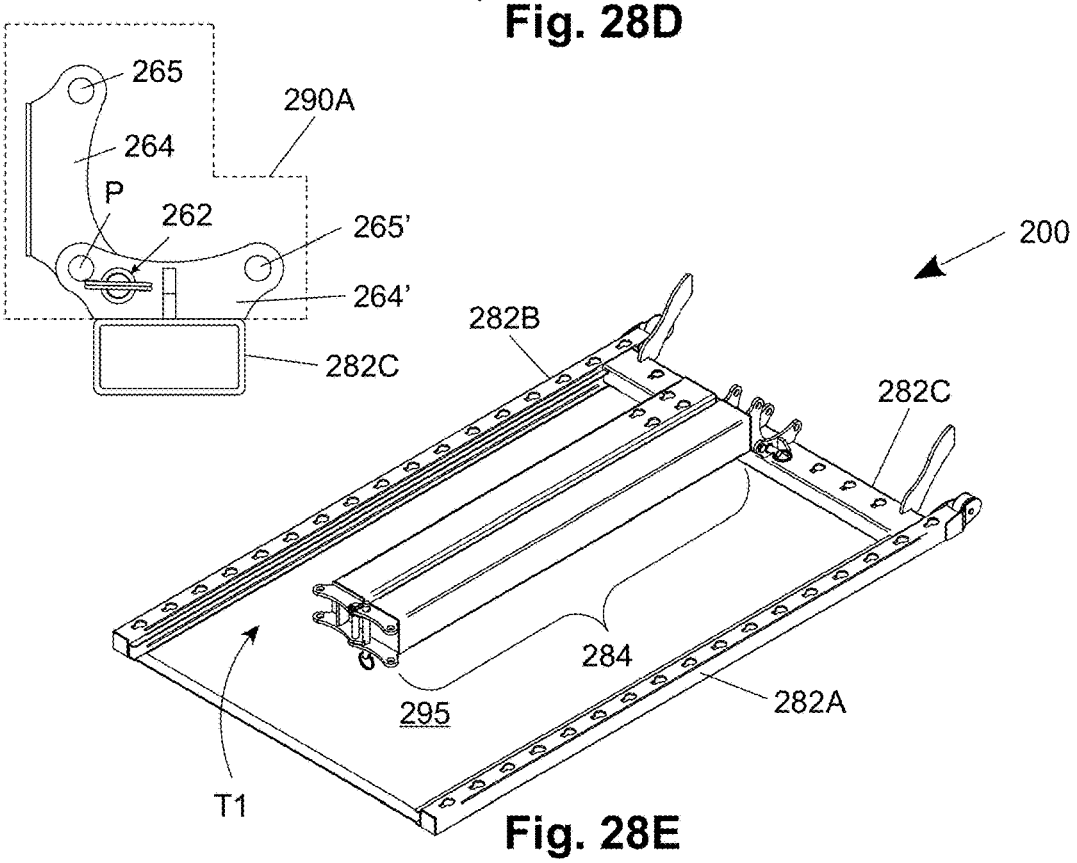

FIG. 28D illustrates that the partially folded collapsible frame 284 is rotatable in a sagittal plane (as shown by arrow R2), whereby the distal end of the first frame section 284A and the proximal end of the second frame section 284B are foldable towards the base platform 282, thereby further reducing the height and thus the volume of the exercise equipment 200. FIG. 28E shows the exercise equipment 200 after the partially folded frame 284 has been folded towards the base platform 282, thereby completely folding the exercise equipment 200 for transportation or storage. FIG. 28E also shows a front view of the first hinge assembly 290A, with a first element 264 and a second element 264', hingedly coupled at a pivot point P by a pivot pin P' (see FIG. 28G). The first element 264 includes an aperture 265 and the second element 264' includes an aperture 265'. When the apertures 265 and 265' are aligned and a pin inserted therethrough, the frame 284 is locked to and securely, vertically supported on the base platform 282. When the pin is removed, the frame 284 is unlocked from the base platform 284 and the two can be rotated relative to each other.

Figure 28F:
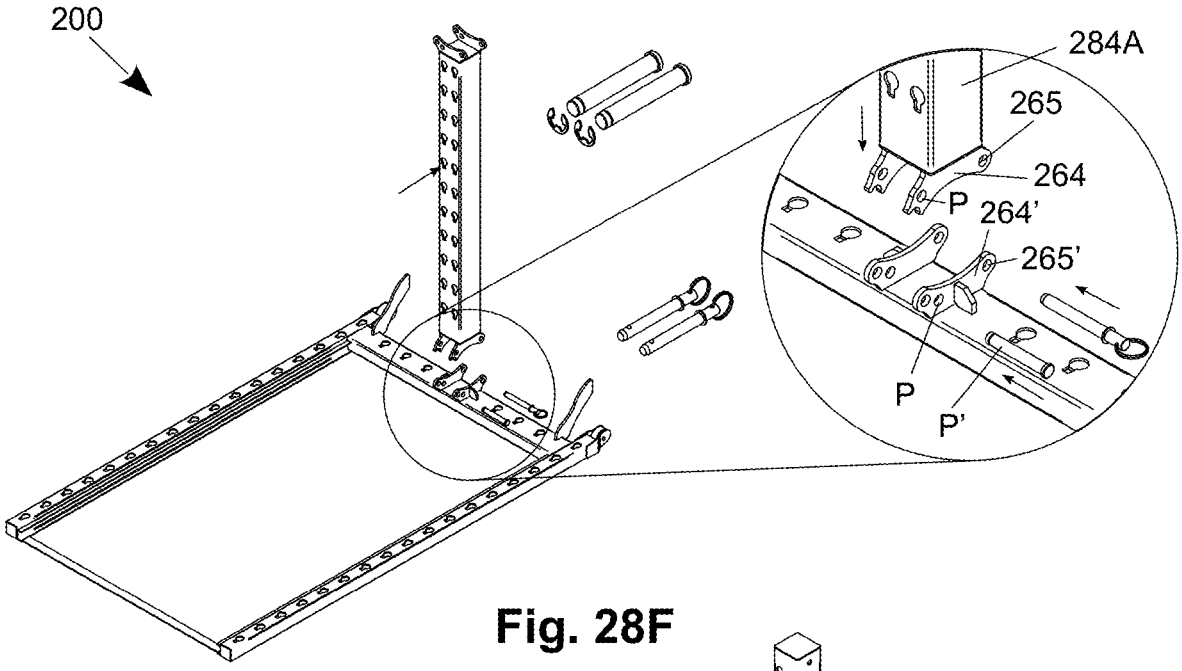
Figure 28G:
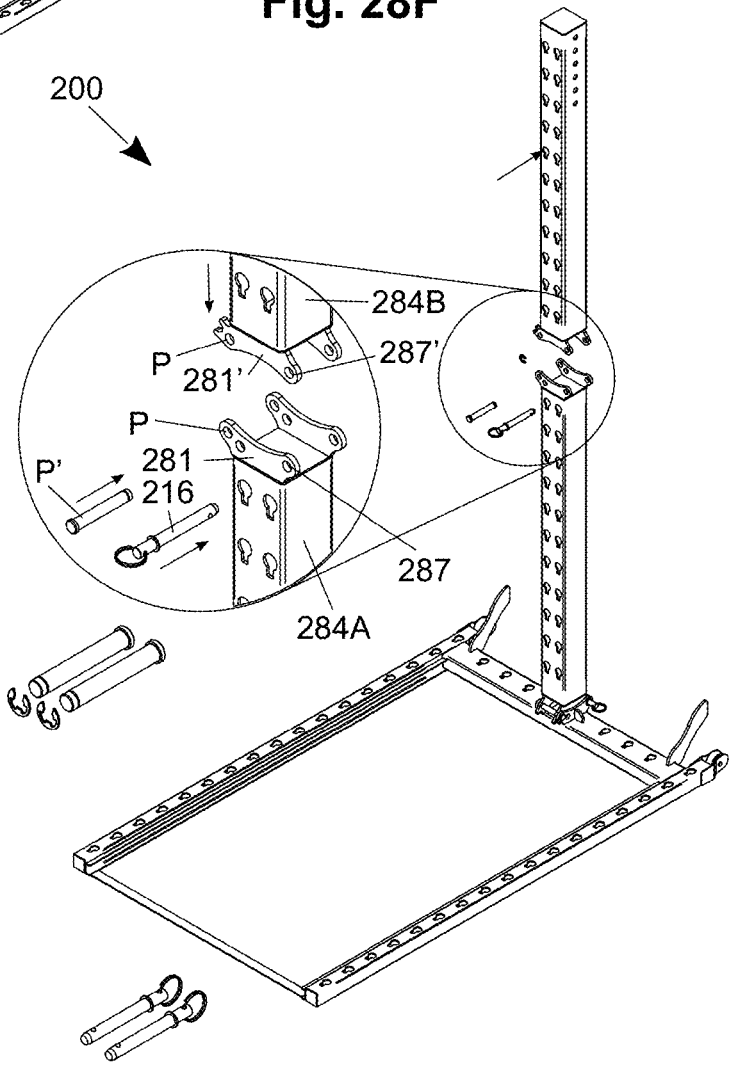
Figure 28H:
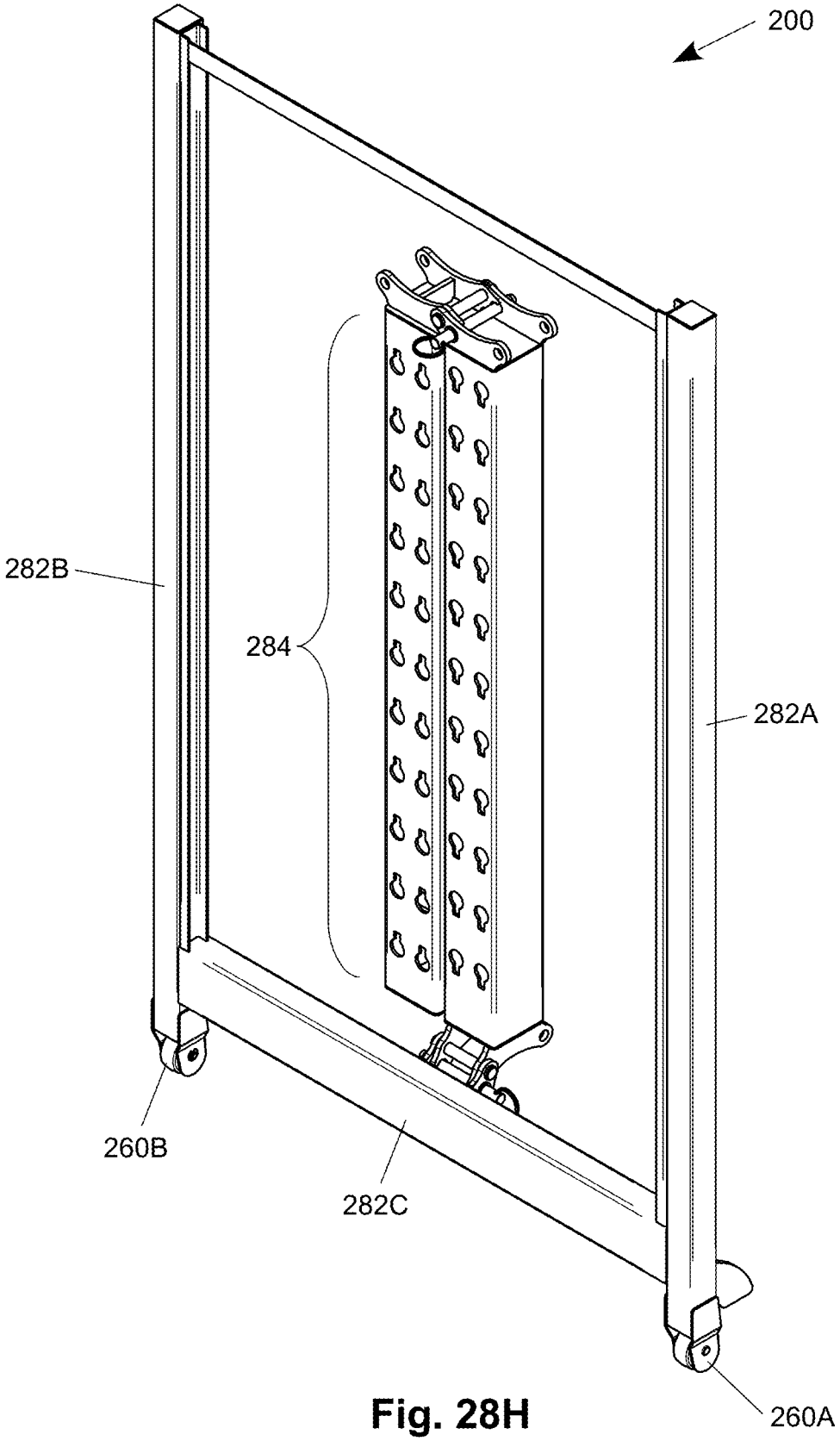

FIGS. 28F and 28G show exploded views of the hinge assemblies 290A and 290B, respectively. FIG. 29H shows the exercise equipment 200 after it has been folded and tilted onto its wheels 260A and 260B (as shown by arrow T1 in FIG. 28E) for easy transportation.

Figure 29A:
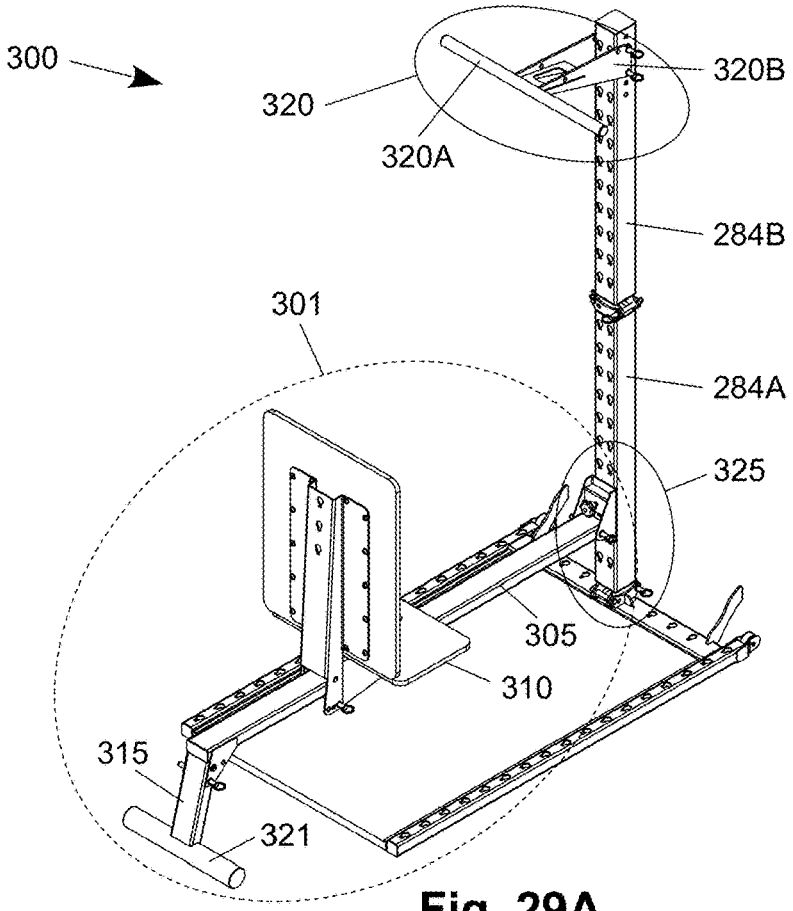
FIGS. 29A-B illustrate perspective views of exercise equipment with exercising accessories attached, in accordance with embodiments.

FIGS. 29A-L show exercising accessories coupled to the exercising equipment 200 of FIGS. 28A-H. FIG. 29A shows an embodiment in which the exercising equipment 200 includes two exercising accessories, a pull-up bar assembly 320 and a bench assembly 301. The pull-up bar assembly 320 is coupled to the fastener sites 297A and 297B on the opposing side surfaces of the second frame section 284B. It will be appreciated that the label 297A refers to one or more frame fastener sites on the first side face of the second frame section 284B, and the label 297B refers to one or more corresponding/matched frame fastener sites on the opposing second side face of the second frame section 284B. It will be appreciated that exercising accessories can be attached to the second frame section 284B on any number of fastener sites. The pull-up bar assembly 320 includes a bar 320A coupled to a frame 320B having multiple frame holes. The pull-up bar 320A is secured to the second frame section 384B by aligning the frame holes with corresponding frame fastener sites 297A and 297B (e.g., apertures) and inserting pins through the aligned holes and frame fastener sites. Preferably the fastener sites 297A and 297B are located at multiple heights above the base platform 282, thereby allowing the pull-up bar 320A to be positioned at different heights above the base platform 202, thereby giving users flexibility in their exercise routines.

It will be appreciated that while the embodiments show coupling the exercise accessories to the frame fastener sites using aligned holes and pins inserted therethrough, other securing means are contemplated.

Figure 29B:
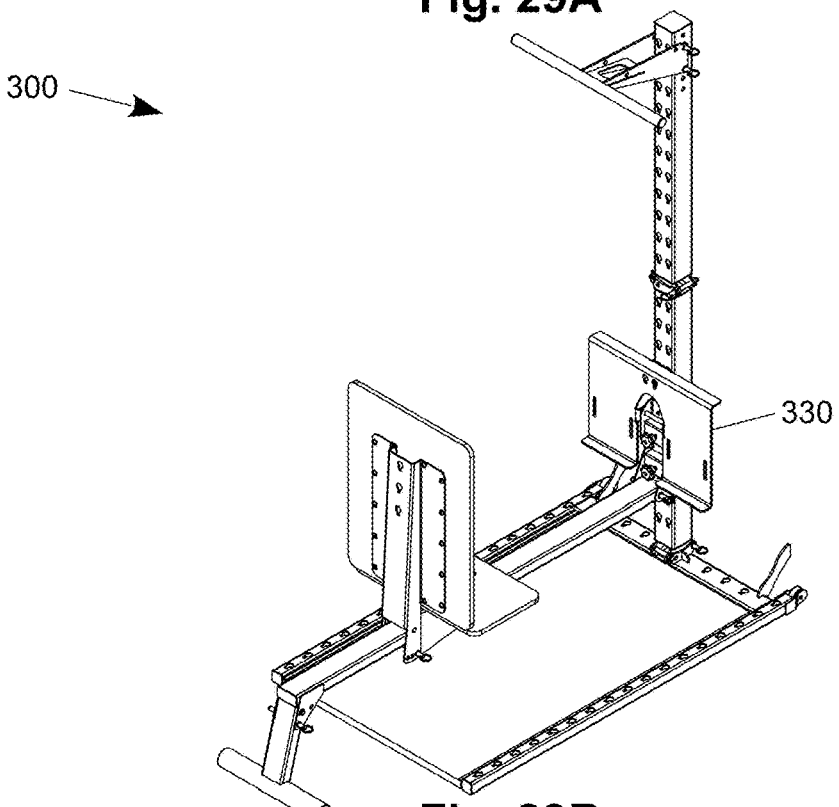

The bench assembly 300 includes a seat 310 coupled to a slidable seat track 305. The slidable seat track 305 is coupled at a first end to an adjustable leg assembly comprising a leg 315 and a foot 321 and at a second end to the frame fastener sites 292A and 292B by a securing means 300E. In some embodiments, as shown in FIG. 29B, the exercise equipment 200 also includes a foot plate 330 coupled to the frame fastening sites 297A and 297B. In the embodiments of FIGS. 29A-B, the foot 300D rests outside the area 295. In other embodiments, the foot 300D rests inside or on the area 295. In still other embodiments, the leg assembly is directly attached to or otherwise coupled to the rails 282A and 282B, thereby providing stability when a user presses on the element 330.

FIGS. 30A-D show exercise equipment 400 having an exercising accessory that includes a rowing machine and leg press assembly. The rowing machine and leg press assembly includes a seat track 305 coupled at a first/proximal end to the frame 284 by a track securing assembly 325. The seat track 305 is coupled at a second/distal end to legs 311A and 311B, which in turn are coupled to any of several matched base platform fastener sites 286A and 286B. The seat track 305 supports a seat 310 or 310A and is coupled to the seat 301 or 310A by a seat securing assembly 312. The track securing assembly 325 includes a knob for releasably attaching/detaching the seat track 305 to/from the frame 284. For ease of explanation, the seat track 305, legs 311A/B, seat securing assembly 312, and track securing assembly is referred to as the seat track assembly 350.

Figure 30A:
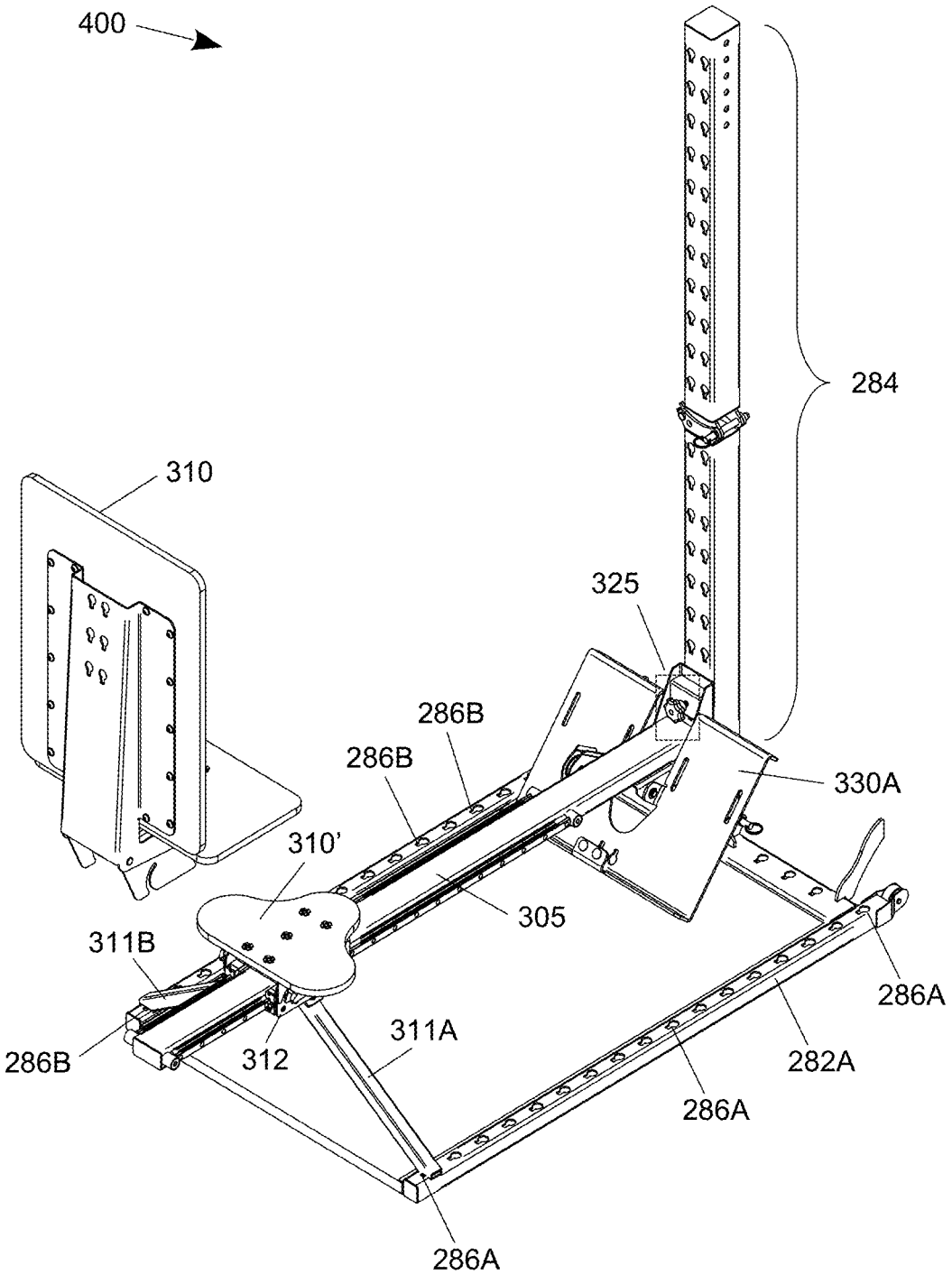
FIGS. 30A-E illustrate perspective views of exercise equipment including a rowing machine leg press attachment and component elements in accordance with some embodiments.
Figure 30B:
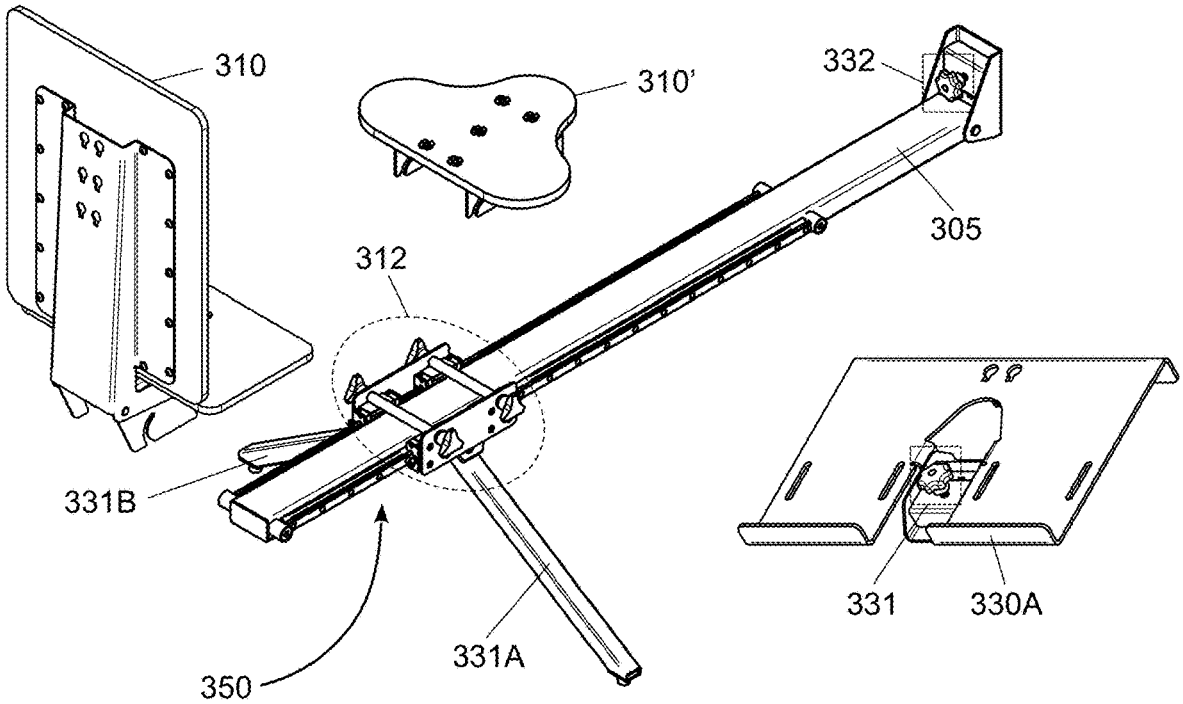
Figure 30C:
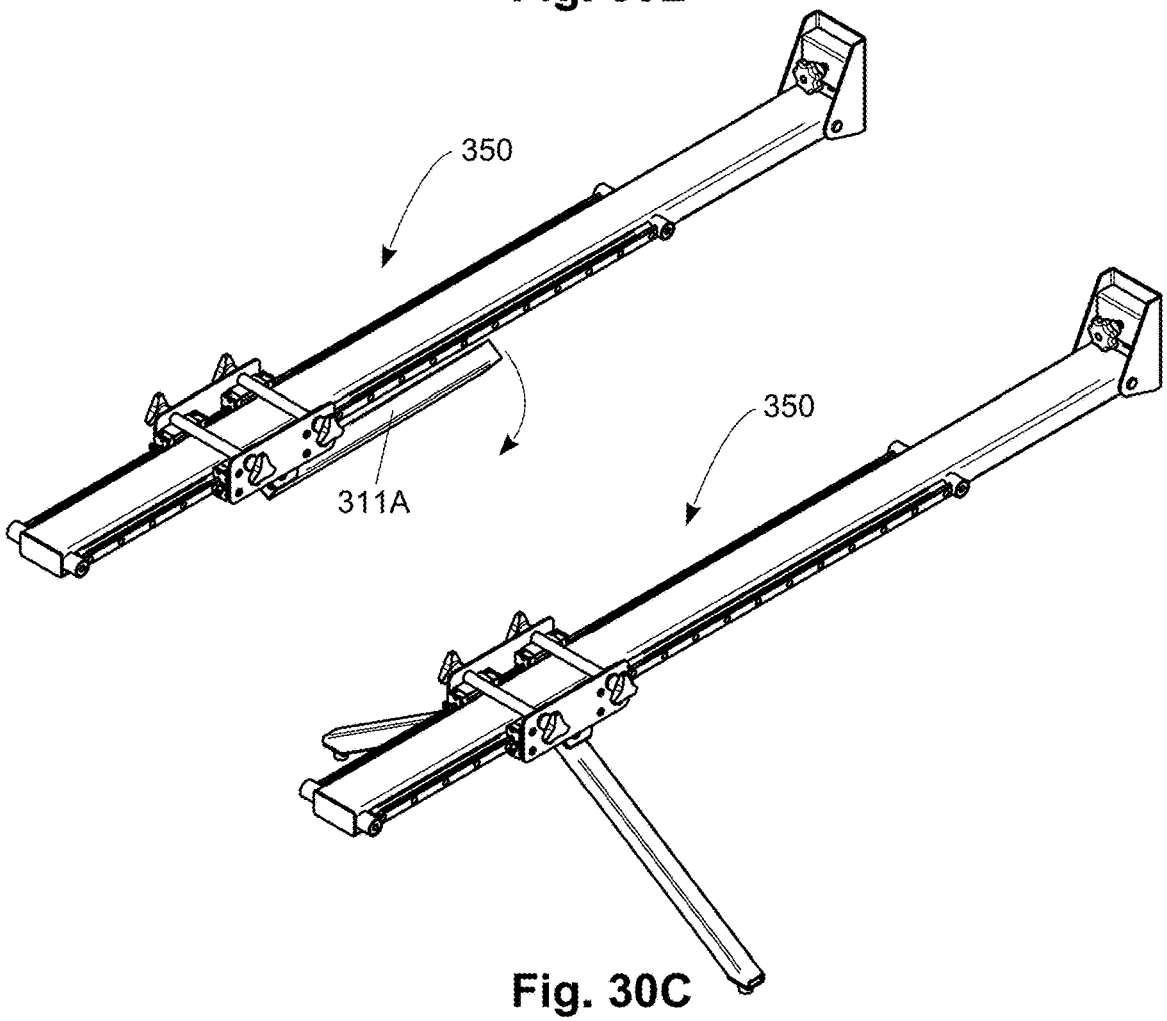
Figure 30E:
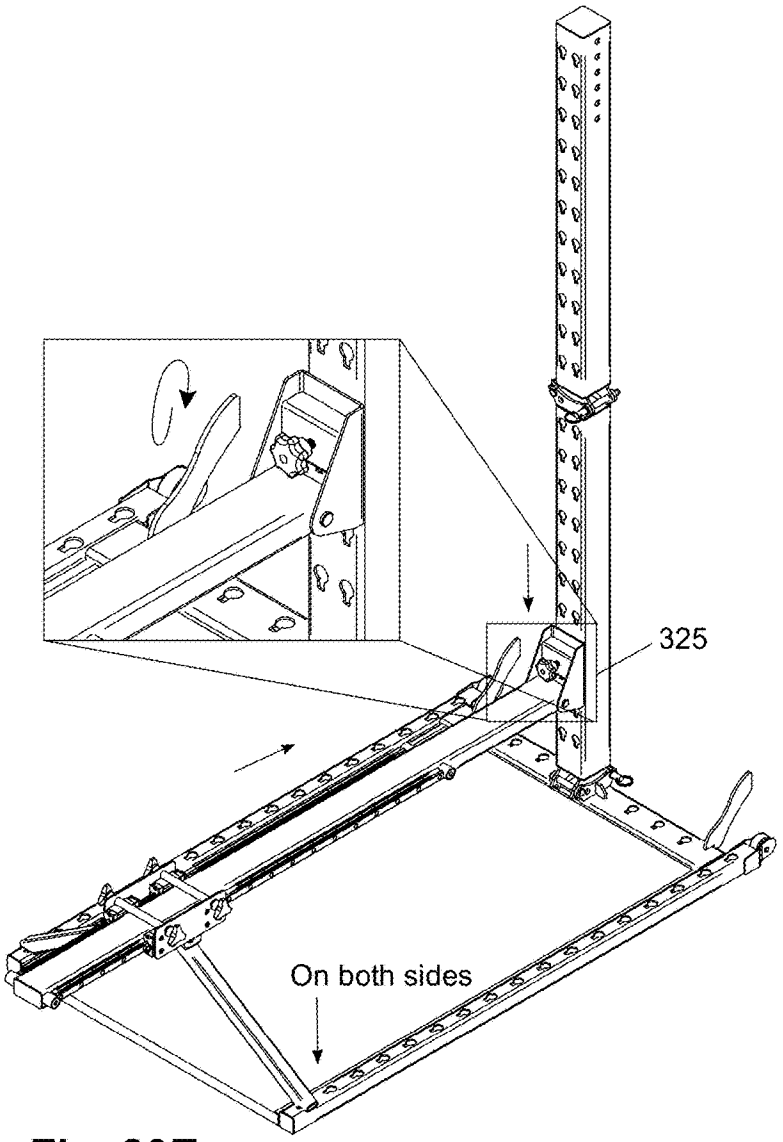
Figure 30D:
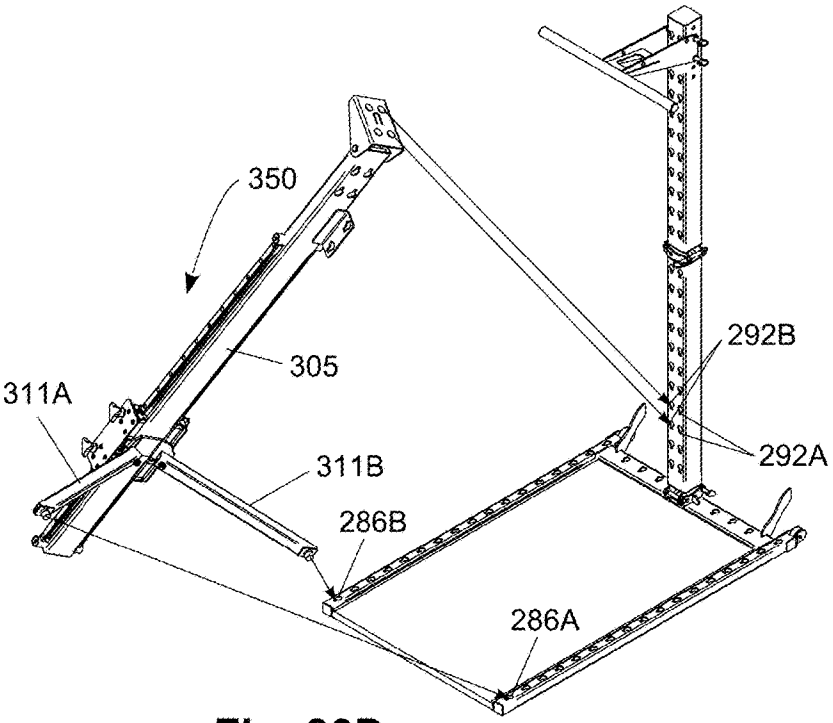

FIGS. 30B-C show the components of the rowing machine and leg press assembly of FIG. 30A in more detail. FIGS. 30B-C show the rowing machine and leg press assembly when the legs 311A-B are in folded and unfolded positions, respectively. FIGS. 30D-E show the rowing machine and leg press assembly before and after attachment to the frame 284 and to the base platform 282 at frame fastener sites 292A/B and base platform fastener sites 286A/B respectively.

Figure 31B:
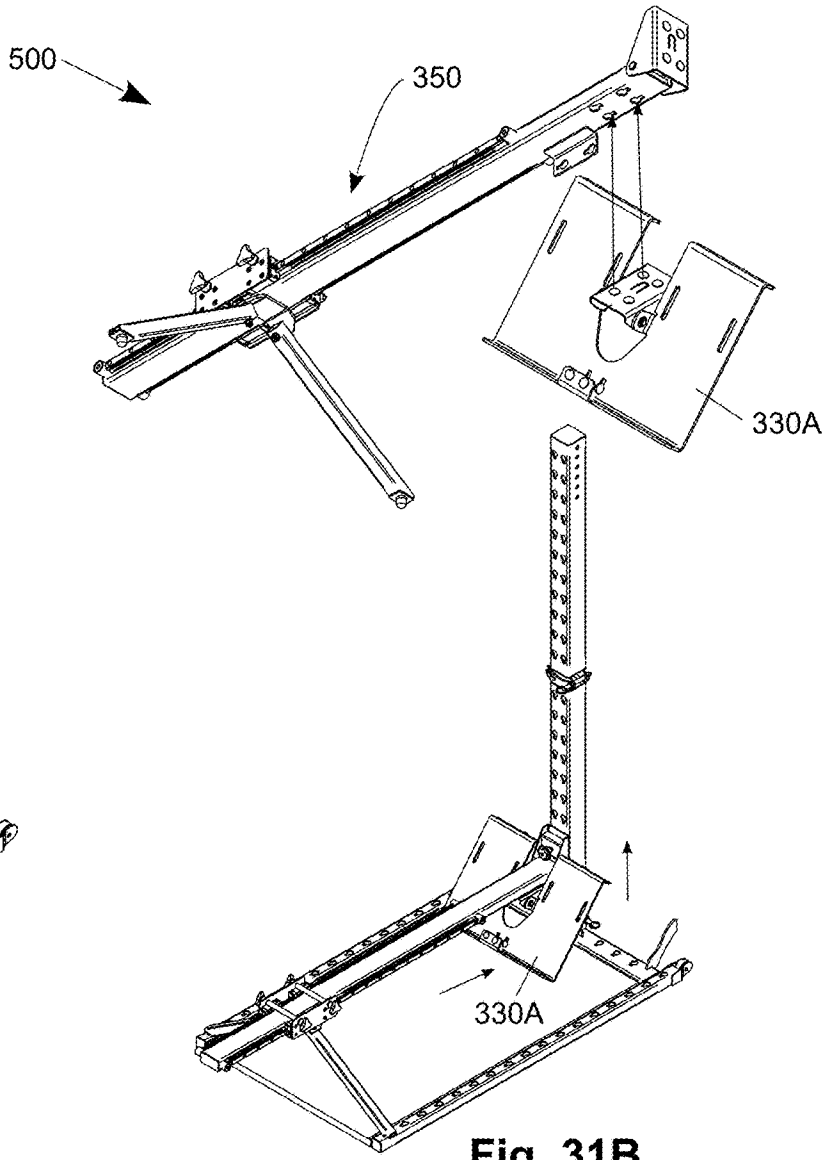
FIGS. 31A-C illustrate perspective views of exercise equipment comprising an exercising accessory including a rowing machine leg press attachment in accordance with some embodiments.
Figure 31A:
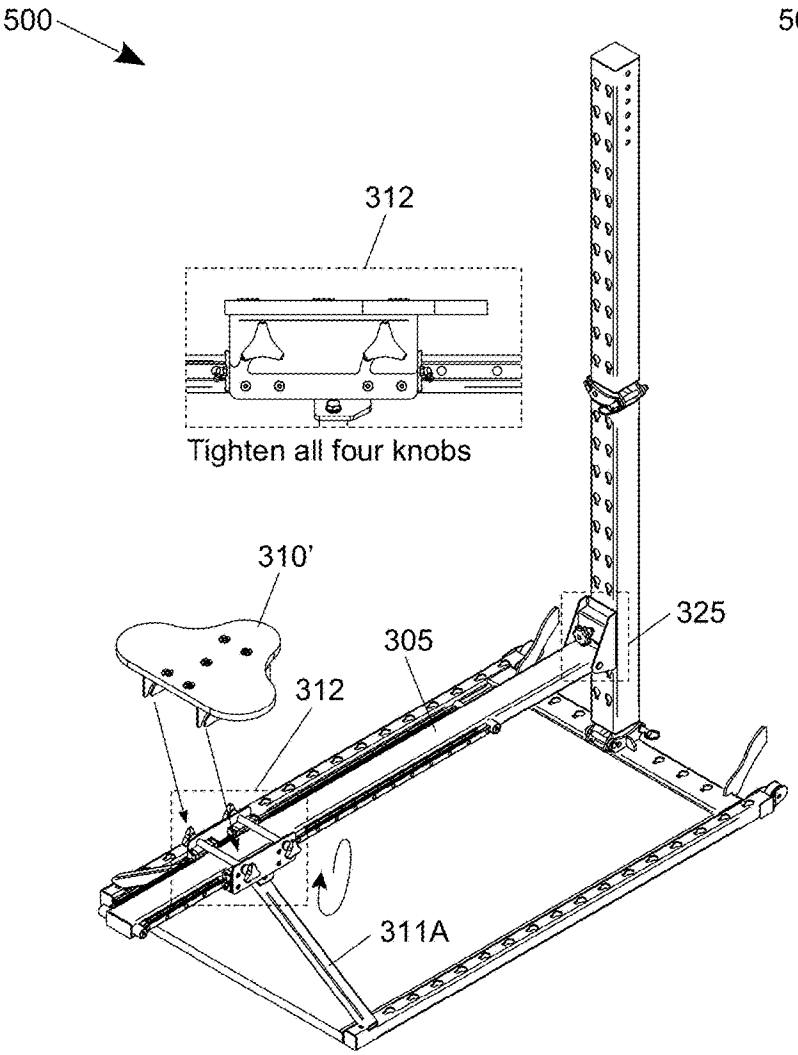
Figure 31C:
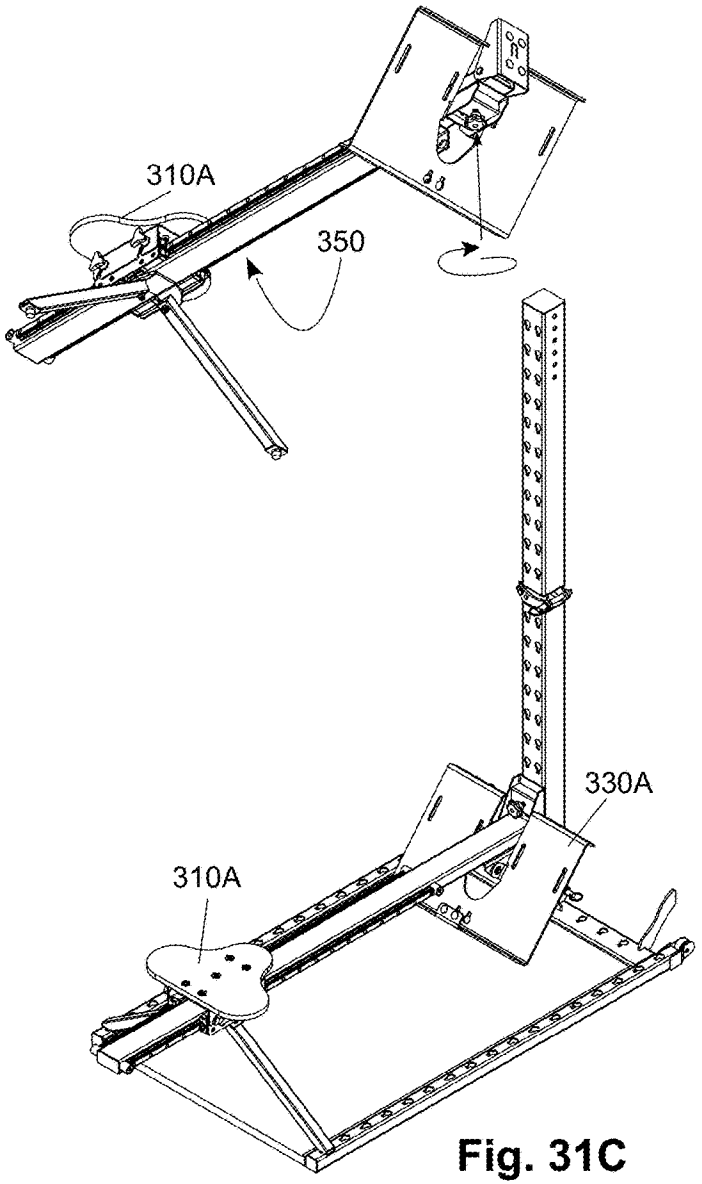

FIGS. 31A-C show the steps of assembling exercise equipment 500 having an exercising accessory including a rowing machine configuration in accordance with some embodiments. The exercise equipment 500 includes many of the same components as the exercise equipment 400. As shown in FIG. 31A, the seat 310A is coupled to the seat track 305 by the seat securing assembly 312, shown in more detail. The seat securing assembly 312 includes four tightening knobs for securely coupling the seat 310A to and from the seat track 305. FIG. 31A shows how the seat 310A is first secured to the seat track 305 using the seat securing assembly 312, in accordance with some embodiments. FIG. 31B shows how the seat track assembly 350 is next secured to the foot plate 330A, in accordance with some embodiments. FIG. 31C shows how the seat track 350 is next secured to the frame 282.

Figure 32A:
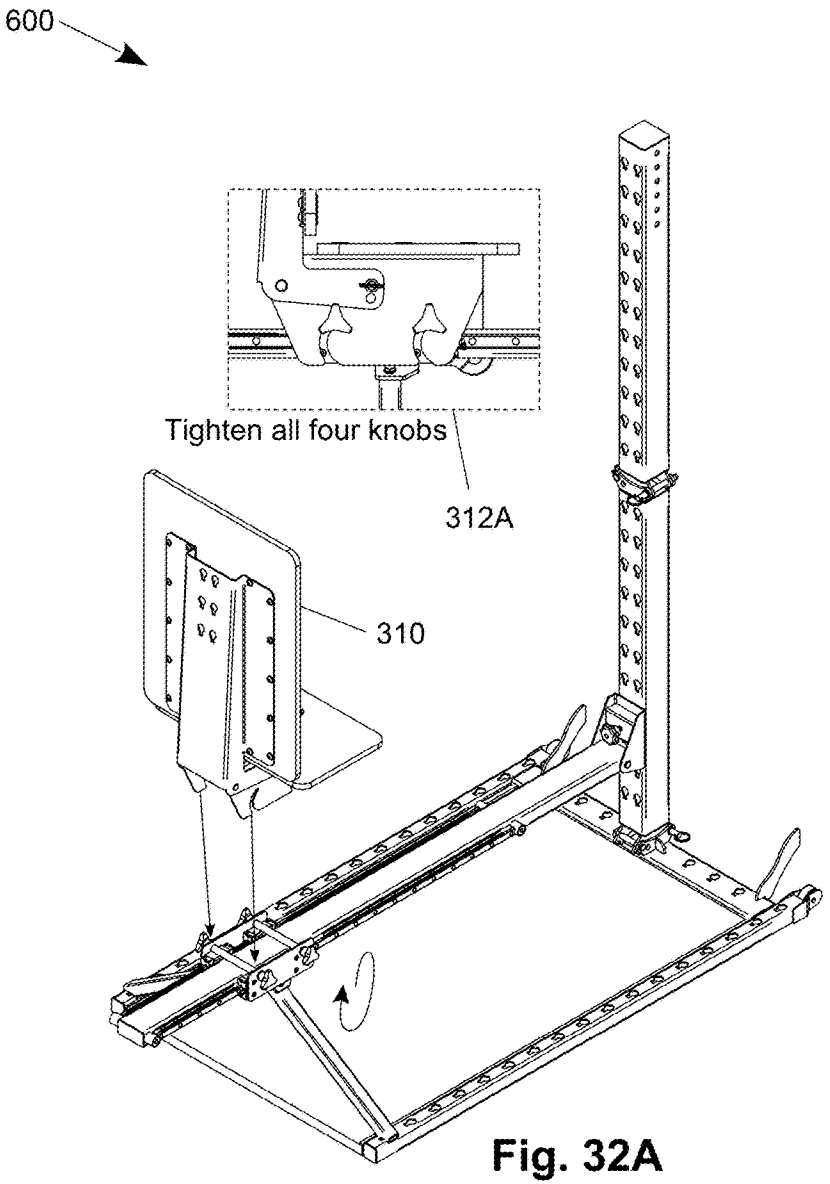
FIGS. 32A-C illustrate perspective views of exercise equipment comprising an exercising accessory including a leg press attachment in accordance with some embodiments.
Figure 32C:
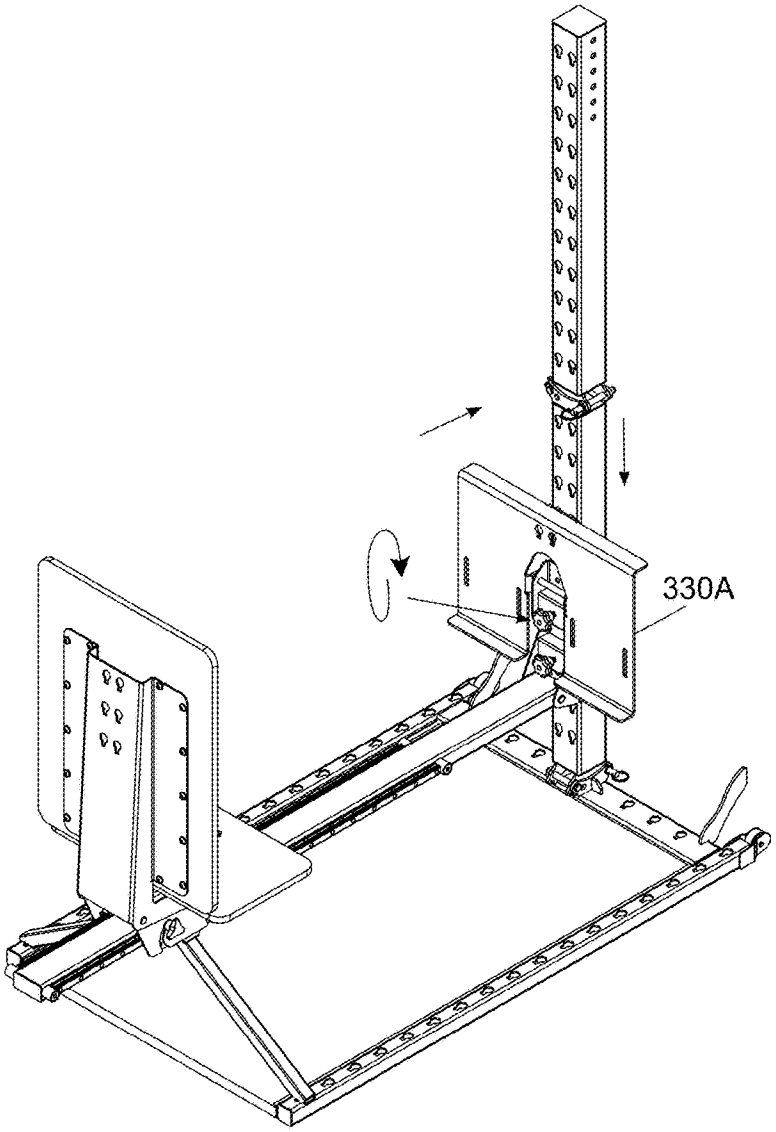
Figure 32B:
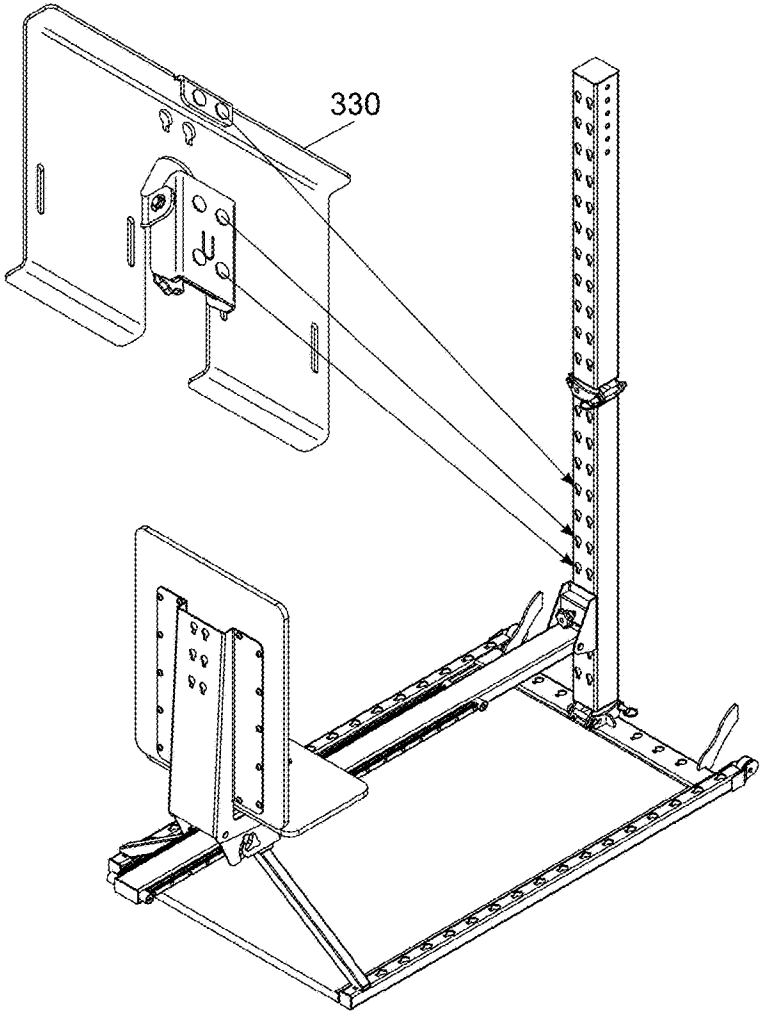
Figure 33:
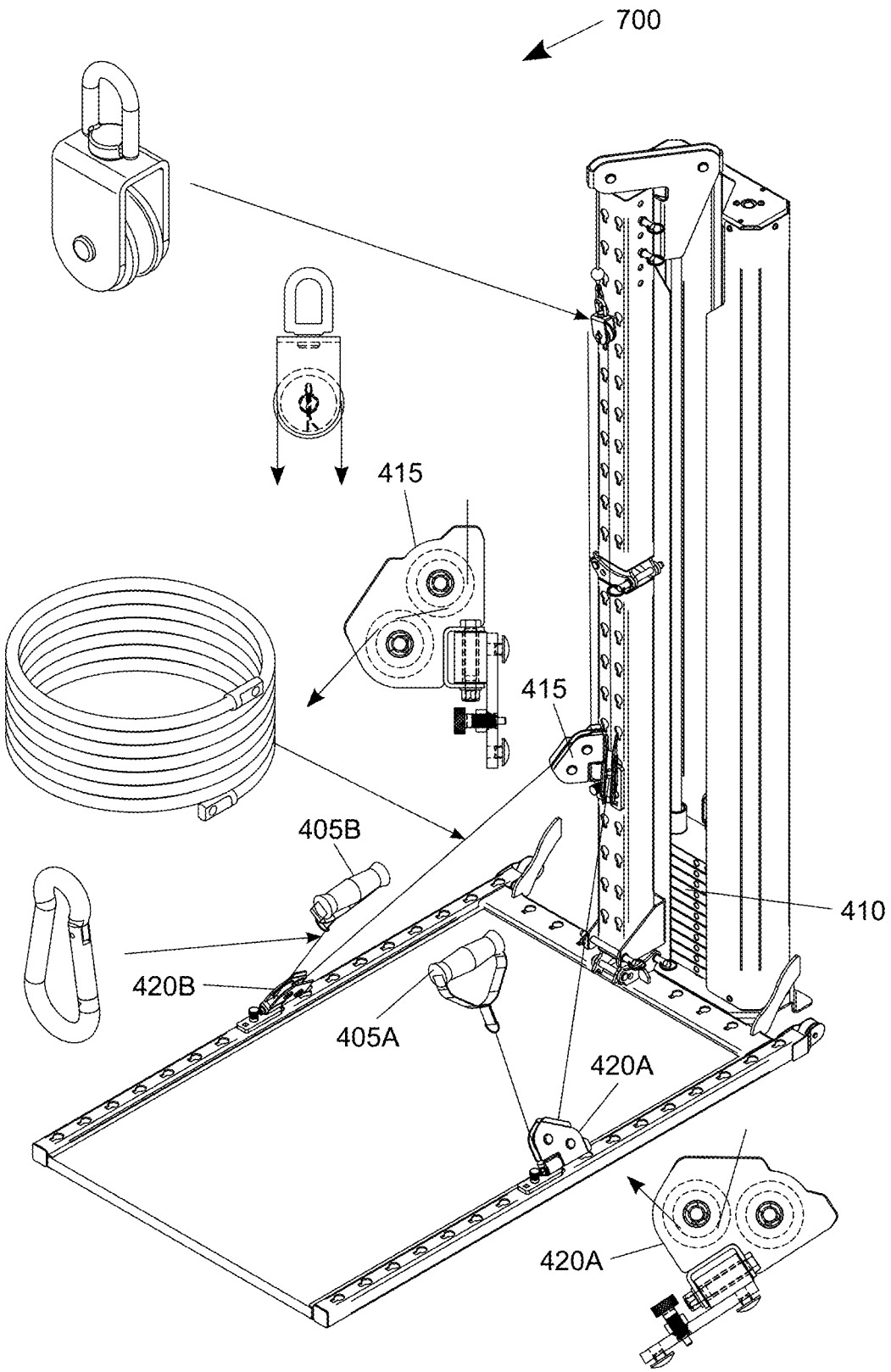
FIG. 33 illustrates a perspective view of exercise equipment comprising an exercising accessory including a weight stack in accordance with some embodiments.

FIGS. 32A-C show exercise equipment 600 having an exercising accessory including a leg press configuration, during different stages of assembly. The exercise equipment 600 includes many of the same components as the exercise equipment 500. As shown in FIG. 32A, the exercise equipment 600 includes a seat securing assembly 312. FIG. 32B illustrates how the holes in the foot plate 330A are aligned with fastener sites 292A/B. FIG. 32B illustrates how the foot plate 330A is then secured to the frame 284, using rotatable knobs, such as described herein. FIG. 32C shows the exercise equipment 600 after the foot plate 330A has been secured to the frame 284. FIG. 33 shows exercise equipment 700 having an exercising accessory including a weight stack 410. The collapsible frame 284 supports the weight stack 410. The weight stack 410 is coupled through a pulley arrangement 410A-B to handles 405A-B.

It will be appreciated that while FIGS. 28A-30 show several exercise accessories attached to the base structure, many other exercise accessories can be attached, including, but not limited, to other accessories described in other embodiments herein.

For example, by attaching a rowing machine element (e.g., where the seat is able to slide back and forth) to the vertical pillar (e.g. frame 284 in the unfolded, locked configuration), the exercise equipment 200 can be configured as a Smith Machine. It will be appreciated that the Smith Machine's function is to confine movements in the vertical direction only. The rowing machine accessory can also be used for leg presses. In some embodiments, an accessory can also be used to perform T-bar exercises. By attaching the rowing machine accessory vertically to the vertical post, the exercise equipment provides "assisted lift" for pull-up exercises.

Embodiments include three modes of "force generation": Mode 1, a weight set that is attached to the back of the exercise equipment (behind the vertical post). Mode 2, strength bands; Mode 3, a motor. In some embodiments, all of these force generation mechanisms transfer the force through a series of cables to the appropriate position on the exercise equipment.

Figure 34:
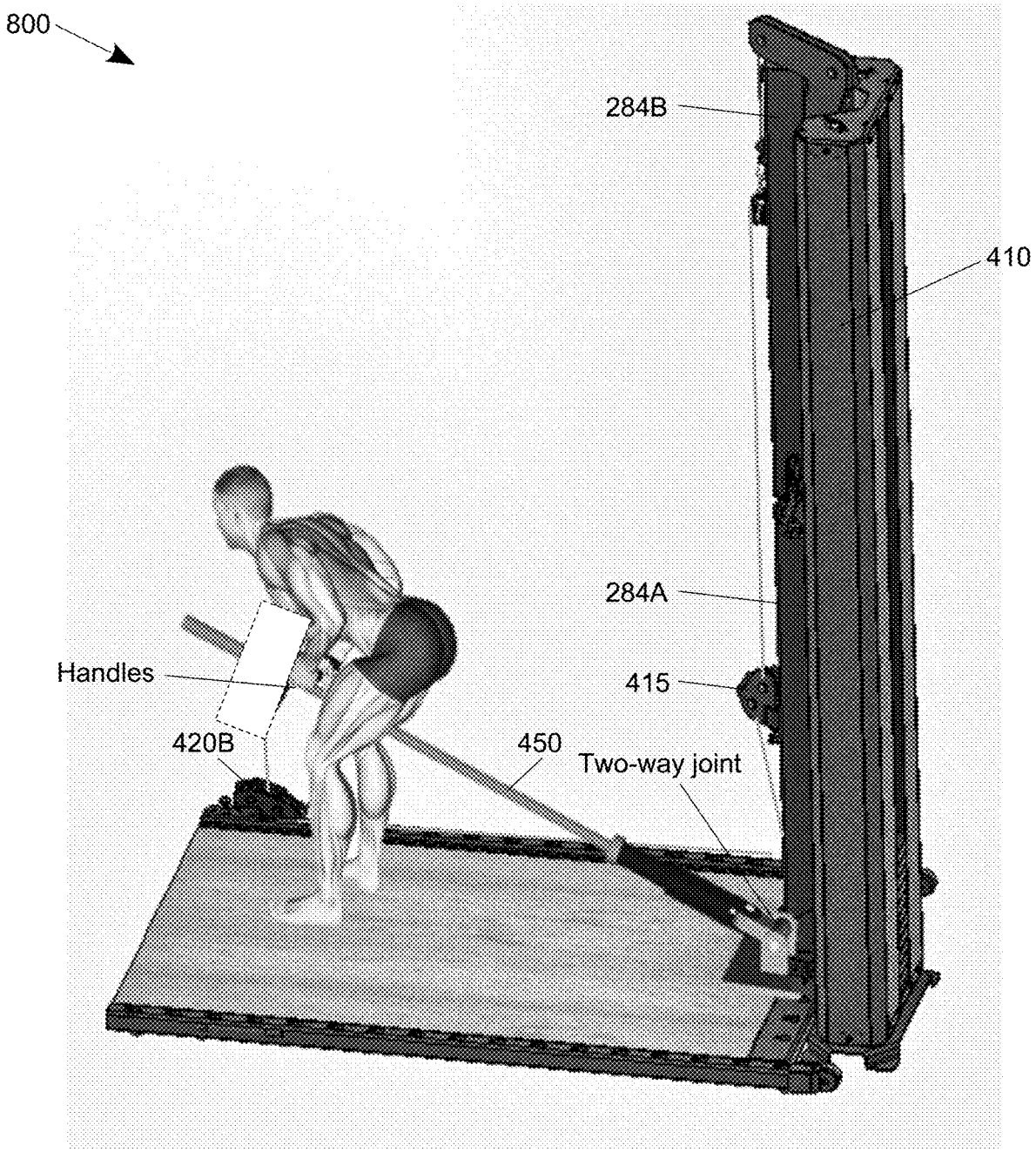
FIG. 34 illustrates exercise equipment comprising an exercising accessory comprising a T-Bar coupled to a weight module in accordance with some embodiments.

FIG. 34 shows exercise equipment 800 configured as a T-Bar, in accordance with some embodiments. The exercise equipment 800 includes some of the components of the exercise equipment 700. The exercise equipment 800 also includes a bar 450 coupled by a two-way joint to the weight stack 410 by a pulley 415. The exercise equipment 800 simulates a user lifting a bar bell (shown in phantom) at the end of the bar 450. Because the weight comes from the weight stack 410, no bar bell is required. Thereby reducing the cost of the exercise equipment.

Figures 35A, 35B, 35C:
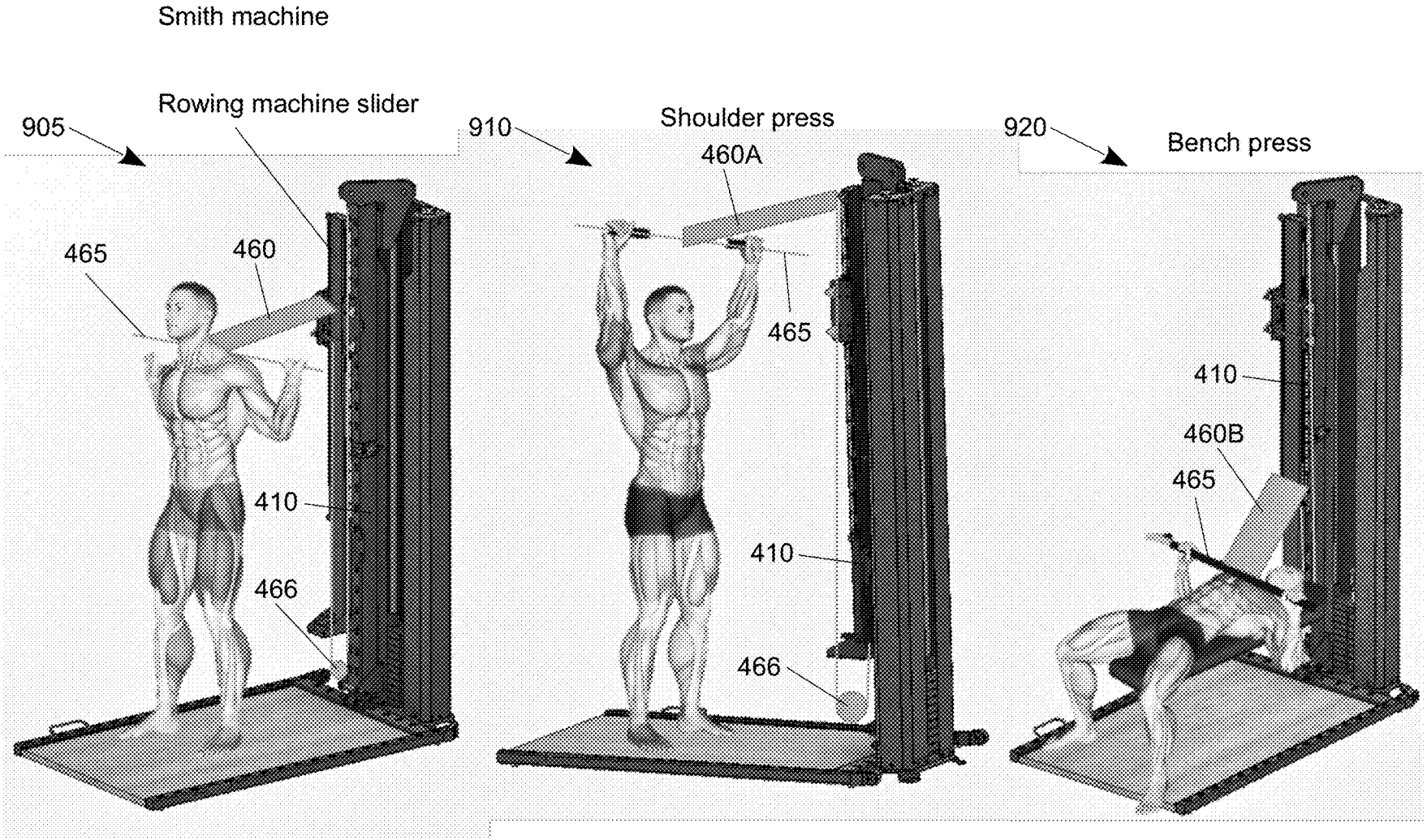
FIGS. 35A-C illustrate exercise equipment implemented as a Smith machine in accordance with some embodiments.

FIGS. 35A-C illustrate exercise equipment 905, 910, and 920, respectively, simulating a Smith machine, in accordance with some embodiments. In FIG. 35A, the exercise equipment includes an exercise accessory having a weight stack 410 coupled to a pulley 466. In different configurations, the pulley 466 is coupled to a rigid bar 460 coupled at one end to a handlebar 465. In operation, a user can move the handlebar 465, to move weights in the weight stack 410, to simulate a Rowing Motion Slider (FIG. 35A), a Shoulder Press (FIG. 35B), and a Bench Press (FIG. 35C).

Figure 36:
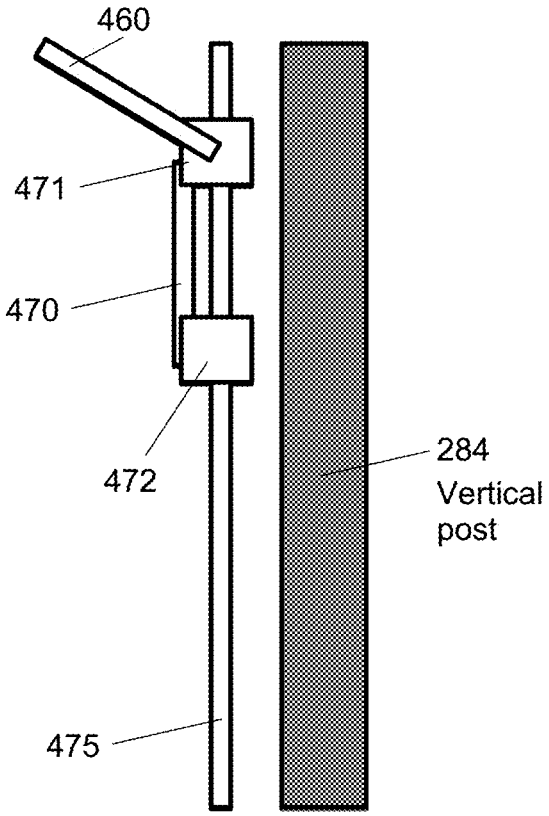
FIG. 36 is a detailed view of components of the Smith machine in FIGS. 35A-C in accordance with some embodiments.

FIG. 36 is a side cross-sectional view of components of the exercise equipment 905, in accordance with some embodiments. As shown in FIG. 36, a first set of bars 475 holds in place the rowing machine rollers 471 and 472. The rowing machine rollers 471 and 472 are coupled by a bar 470, which provides additional mechanical stability. The machine roller 471 is coupled to the bar 460. The bar 460 is the connection to the Smith Machine.

Figure 38:
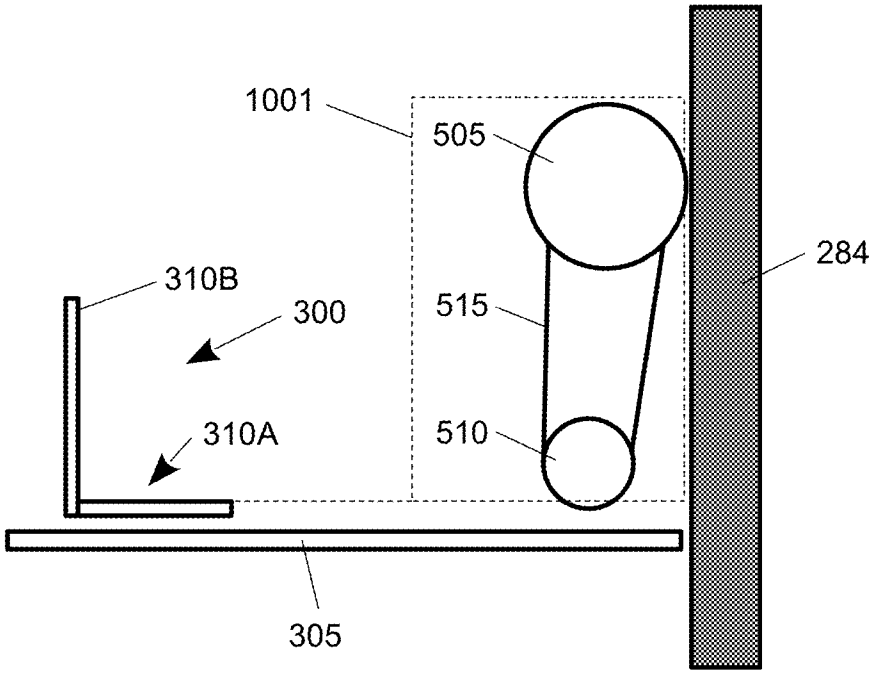
FIG. 38 illustrate the bicycle assembly of FIG. 37, relative to a seat on the exercise equipment in accordance with some embodiments.
Figure 37:
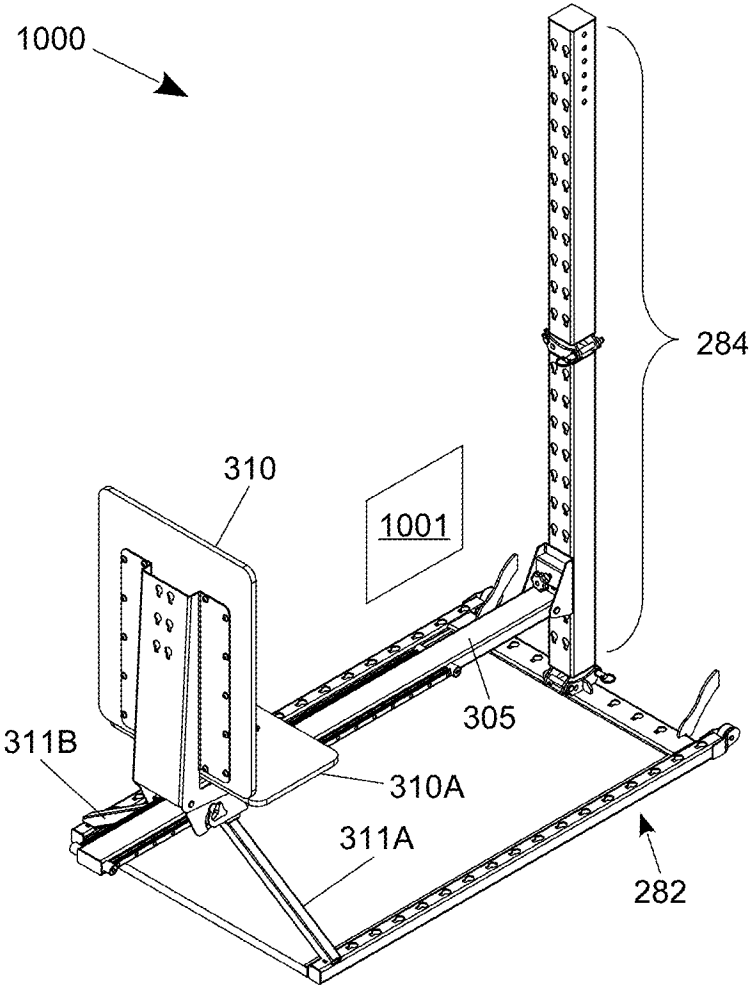
FIG. 37 illustrates exercise equipment comprising an exercising accessory including a bicycle assembly in accordance with some embodiments.

FIG. 37 illustrates exercise equipment 1000 having an exercise accessory that includes a bicycle attachment in accordance with some embodiments. The exercise equipment 1000 includes some of the same components as the exercise equipment 600. FIG. 37 illustrates where the bicycle attachment 1001 is configured in relation to the other components. As shown in FIG. 38, the bicycle attachment 1001 includes a flywheel 505 and resistance element 515 coupled to the frame 284 (vertical post). The resistance element 515 couples the flywheel 505 to the pedal assembly 510. The pedal assembly 510 includes pedals on opposite sides. The pedal assembly 510 is able to be coupled to the vertical post 284 or to one or both of the rails 282A/B. The flywheel 505 and pedal assembly 510 are coupled by a chain, such that when the pedals rotate, the flywheel 505 also rotates. As explained below, the distance between the pedals and the seat 310 can be adjusted in at least two ways. For example, the seat 310 can be moved forward, towards the vertical post 284. As a second example, both the flywheel 505 and the pedal assembly 510 can be moved such that the flywheel 505 is lowered and the pedals are closer to the seat.

Figures 39A, 39B, 39C:
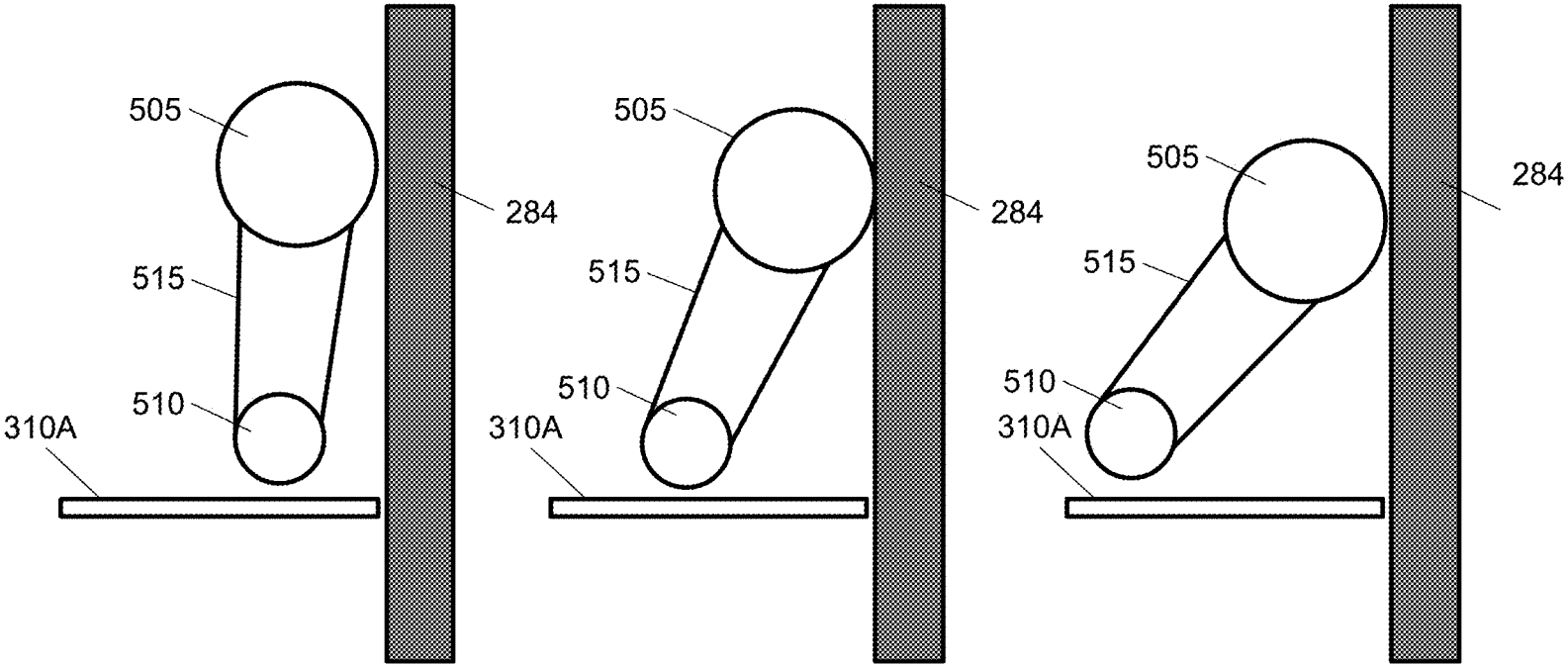
FIGS. 39A-C illustrate the bicycle assembly of FIG. 37, with the pedals and flywheel of the bicycle assembly adjusted to different settings/configurations for a user in accordance with some embodiments.
Figure 40C:
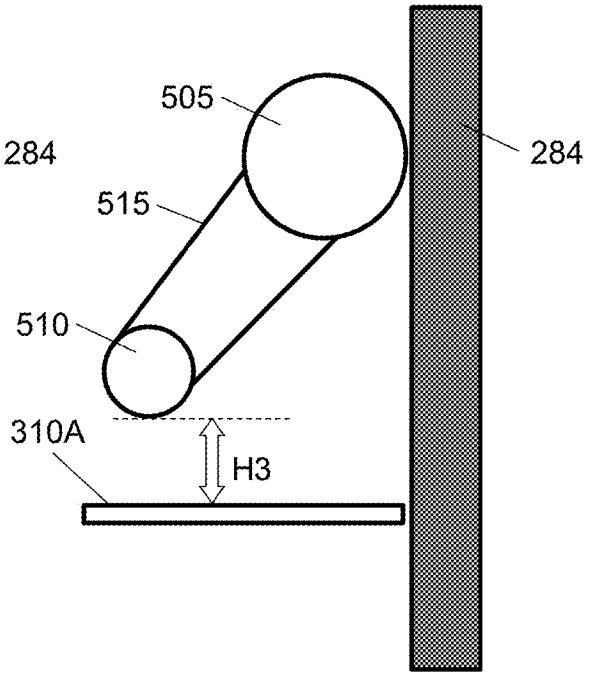
FIGS. 40A-C illustrate the bicycle assembly of FIG. 37, with the pedals and flywheel of the bicycle assembly adjusted to different/setting for a user in accordance with some embodiments.
Figure 40B:
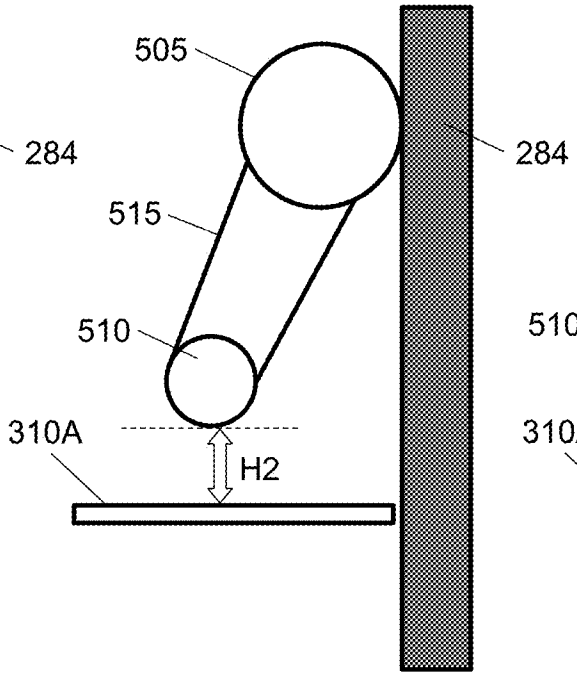
Figure 40A:
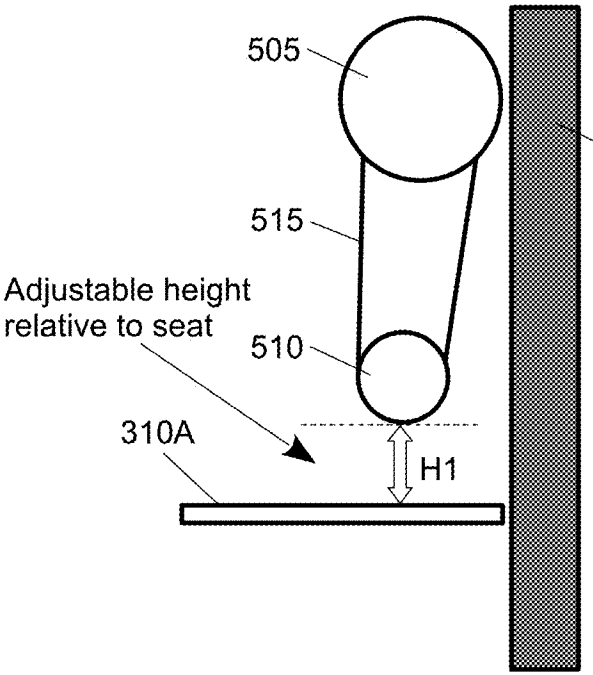

FIGS. 39A-C show embodiments in which the pedal assembly 510 is moved increasingly farther from the vertical post 284, that is, closer to the backrest 310B of the seat 310, while the flywheel 505 is moved closer to the horizontal surface 310A of the seat 310 (illustrated as extended along the transverse plane merely to more clearly show the distances), thereby accommodating shorter people. FIGS. 40A-C show embodiments in which the pedal assembly 510 is moved increasing farther from the vertical post 284 and at increasingly higher distances H1, H2, H3 from the horizontal surface 310A, thereby allowing for other height/distance configurations to meet user needs.

The base structure provides a starting point for a modular system where each accessory can be considered a module that can be attached to the base structure. This provides flexibility to the user to only purchase those accessories they are interested in, as opposed to buying a integrated system that includes multiple features that may or may not be desirable to the user.

The present invention has been described in terms of specific embodiments incorporating details to facilitate the understanding of the principles of construction and operation of the exercise equipment. Such references, herein, to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. Exercise equipment comprising:

a. a base platform comprising a plurality of base platform fastener sites configured for attaching an exercising accessory to the base platform;

b. a hinge structure comprising first and second hinges; and c. a collapsible frame comprising first and second frame sections, the first and second frame sections comprising a plurality of frame fastener sites configured for attaching the exercising accessory to the collapsible frame, wherein the first hinge couples the base platform to the collapsible frame, the second hinge comprises a first leaf coupled to the first frame section and a second leaf coupled to the second frame section, the first hinge configured to rotate the base platform relative to the collapsible frame in a first plane, the second hinge configured to reversibly fold the second leaf to overlie the first leaf to thereby rotate the second frame section relative to the first frame section in a second plane orthogonal to the first plane, such that the first and second frame sections fold upon each other, the rotations to expand and collapse the exercise equipment into folded and unfolded configurations.

2. The exercise equipment of claim 1, wherein in the unfolded configuration, the frame fastener sites are arranged in parallel columns extending from a proximal end of the first frame section relative to the base platform to a distal end of the second frame section relative to the base platform.

3. The exercise equipment of claim 2, wherein in the unfolded configuration, the frame fastener sites are arranged to secure the exercising accessory at different distances from the base platform.

4. The exercise equipment of claim 1, wherein the base platform comprises a planar substrate configured to lie on a flat surface.

5. The exercise equipment of claim 1, further comprising the exercising accessory coupled to one or more of the fastener sites.

6. The exercise equipment of claim 5, wherein the exercising accessory comprises a pull-up bar, a bench attachment, a weight module, a rowing machine assembly, a leg curl assembly, a backrest and horizontal bar assembly, a T-bar, a bicycle assembly, or a Smith Machine assembly.

7. The exercise equipment of claim 6, wherein the exercising accessory comprises:

a seat track for slidably coupling a seat; and legs coupling the seat track to the base platform fastener sites.

8. The exercise equipment of claim 6, wherein the exercising accessory comprises a bicycle assembly comprising a flywheel coupled to a pedal assembly, the pedal assembly comprising pedals, wherein a distance of the pedals from the frame, a distance of the pedals from the seat track, or both are adjustable.

9. The exercise equipment of claim 1, wherein the base platform comprises opposing strips coupled by a cross strip forming a perimeter of an enclosure, such that when the exercising equipment is in the folded configuration, the first and second frame sections are at least partially contained within the enclosure.

10. The exercise equipment of claim 8, wherein the cross bar comprises an anti-roll bar, a wheel set, or both.

11. Exercise equipment comprising:

a. a base platform comprising opposing first and second strips coupled by a cross strip, the base platform comprising a plurality of base platform fastener sites configured for attaching an exercising accessory to the base platform; and b. a collapsible frame comprising first and second frame sections hingedly coupled together and to the base platform, the multiple frame sections comprising a plurality of frame fastener sites configured for attaching the exercising accessory to the collapsible frame, wherein, the first and second sections are configured to rotate relative to each other in a first plane defined by the first strip, the second strip, and the cross strip, orthogonal to a surface of the base platform, and to rotate relative to the base platform in a second plane orthogonal to the first plane, to move the collapsible frame between folded and unfolded configurations.

12. The exercise equipment of claim 11 further comprising a fastener configured to removably fasten and unfasten at each of the plurality of fastener sites, wherein the fastener includes a first fastener element configured to mate with a complementary fastener element at the fastener site and a second fastener element configured to mate with a complementary fastener element on the exercising accessory.

13. Exercise equipment comprising:

a. a base platform comprising a plurality of base platform fastener sites configured for attaching an exercising accessory to the base platform; and b. a collapsible frame coupled to the base platform, wherein the collapsible frame comprises first and second frame sections, the first frame section hingedly coupled to both the second frame section and the base platform, the first frame section having a first face and opposing first side surfaces, the second frame section having a second face and opposing second side surfaces, the first face, the second face, and the opposing second side surfaces each comprising a plurality of frame fastener sites configured for attaching the exercising accessory to the collapsible frame, wherein the exercise equipment is configured such that in a folded configuration, corresponding ones of the first and second side surfaces are folded upon each other and the first frame section is folded upon the base platform, and in an unfolded configuration, the first and second faces are vertically aligned, such that the first section supports the second section on the base platform.

14. The exercise equipment of claim 13, wherein one of the first opposing side surfaces or one of the second opposing side surfaces includes one or more of the multiple frame fastener sites.

15. The exercise equipment of claim 13, wherein the base platform comprises a planar substrate configured to lie on a flat surface and a rigid rail structure positioned along a perimeter of the planar substrate.

16. The exercise equipment of claim 15, wherein the base platform fastener sites are formed in the rigid rail structure.

17. Exercise equipment comprising:

a. a base platform comprising a plurality of base platform fastener sites configured for attaching an exercising accessory to the base platform; and b. a collapsible frame comprising first and second frame sections and a second hinge assembly comprising first and second leafs, the first and second frame sections each comprising corresponding opposing first and second ends, wherein the second hinge assembly couples a second end of the first frame section at the first leaf to the first end of the second frame section at the second leaf, the first and second frame sections comprising a plurality of frame fastener sites configured for attaching the exercising accessory to the collapsible frame, wherein, for a user on the base platform facing the collapsible frame, the second frame section is configured to rotate relative to the first frame section in a frontal plane by moving the second leaf to overlie the first leaf and reversing the movement, and to rotate relative to the base platform in a sagittal plane, together to move the exercise equipment between unfolded and folded configurations.

18. The exercise equipment of claim 17, further comprising a first hinge assembly coupling the first frame section to the base platform.

19. The exercise equipment of claim 17, wherein the second hinge assembly is configured to flip the second leaf to vertically align with first leaf.

20. The exercise equipment of claim 19, wherein the second hinge assembly comprises first and second elements having, respectively, corresponding first and second surfaces and opposing first and second ends, wherein the second end of the first element is coupled to the first end of the second element by a pivot pin, such that when the second element is pivoted about the pivot pin in a first direction, the first surface opposes the second surface to thereby vertically align the first and second frame sections, and when the second element is pivoted about the pivot pin in a second direction opposite the first direction, the first surface does not oppose the second surface.

21. The exercise equipment of claim 20, wherein the first end of the first element comprises a first aperture and the second end of the second element comprises a second aperture, such that when the first element is rotated so that the first and second surfaces oppose each other, the first and second apertures align to receive a locking pin.

* * * * *